US011261691B2

(12) United States Patent
Zeng

(10) Patent No.: US 11,261,691 B2
(45) Date of Patent: Mar. 1, 2022

(54) INTEGRATED COUPLING AND DOWNHOLE PLUGGING SYSTEM AND PLUGGING METHOD

(71) Applicant: Vertechs Petroleum Technology Innovation & Equipment Manufacturing Co., LTD., Sichuan (CN)

(72) Inventor: Qijun Zeng, Chengdu (CN)

(73) Assignee: Vertechs Petroleum Technology Innovation & Equipment Manufacturing Co., Ltd., Chengdu (CN)

( * ) Notice: Subject to any disclaimer, the term of this patent is extended or adjusted under 35 U.S.C. 154(b) by 0 days.

(21) Appl. No.: 17/083,140

(22) Filed: Oct. 28, 2020

(65) Prior Publication Data

US 2022/0018210 A1 Jan. 20, 2022

(51) Int. Cl.
*E21B 23/01* (2006.01)
*E21B 33/129* (2006.01)

(52) U.S. Cl.
CPC ..... *E21B 33/1293* (2013.01); *E21B 23/01* (2013.01)

(58) Field of Classification Search
CPC ..... E21B 23/01; E21B 33/1293
See application file for complete search history.

(56) References Cited

U.S. PATENT DOCUMENTS 3,273,320 A * 9/1966 Delaune ..... B04C 5/081 55/434.1
4,432,246 A * 2/1984 Granat ..... G01L 1/04 73/862.53
6,309,155 B1 * 10/2001 Huang ..... F16B 13/0858 411/55
2005/0038444 A1 * 2/2005 Binder ..... A61B 17/1728 606/96
2013/0186616 A1 * 7/2013 Xu ..... E21B 33/129 166/212
2020/0291739 A1 * 9/2020 Zeng ..... E21B 23/01

FOREIGN PATENT DOCUMENTS

EP 0443720 A2 * 8/1991 ..... F16L 55/13

* cited by examiner

*Primary Examiner* — Cathleen R Hutchins
*Assistant Examiner* — Ronald R Runyan
(74) *Attorney, Agent, or Firm* — Arch & Lake LLP

(57) ABSTRACT

The present disclosure relates to an integrated collet and a downhole plugging system, and a plugging method thereof. The integrated collet includes a collet body, wherein the collet body can form a seal with an inner wall of a downhole casing and is anchored to the inner wall of the downhole casing; an internal channel is formed inside the collet body along an axial direction; and an inner wall of the internal channel of the collet body is a conical surface.

6 Claims, 24 Drawing Sheets

INTEGRATED COUPLING AND DOWNHOLE PLUGGING SYSTEM AND PLUGGING METHOD

CROSS-REFERENCE TO RELATED APPLICATIONS

The present application claims the benefit of Chinese Patent Application No. 2020106812643, filed on Jul. 17, 2020, Chinese Patent Application No. 2020106812713, filed on Jul. 17, 2020, Chinese Patent Application No. 2020106823173, filed on Jul. 17, 2020, and Chinese Patent Application No. 2020106812662, filed on Jul. 17, 2020. The entire contents of the four Chinese applications are hereby incorporated by reference for all purposes.

TECHNICAL FIELD

The present disclosure relates to the technical field of downhole tools in the petroleum and natural gas industry, and in particular to, an integrated collet, a downhole plugging system and a plugging method.

BACKGROUND

Bridge plugs, frac plugs and ball seats are widely used for casing isolation between stages in hydraulic fracturing operation and acidizing of oil and gas wells. In fracturing operation, it is common practice to set the ball seat, the frac plug or the bridge plug at a specified position of a downhole casing through a wireline or a hydraulic setting tool, subsequently perform perforation in the casing above a setting position, then the setting tool is pulled out of the well, a frac ball is pumped down to plug an internal channel of the ball seat, the frac plug or the bridge plug set in a well, and finally carry out fracturing operation. After the above operation is completed, it needs to form a full-bore casing: if the ball seat or the bridge plug is of a soluble or degradable structure and the frac ball is of a soluble structure, they can dissolve by themselves until the full-bore casing is formed to meet the flowback and production demands; and if the ball seat or the bridge plug in the well is of an insoluble structure, or the frac ball is of an insoluble structure, it needs to drill the ball seat or (and) the fracturing ball, and residues arising from drilling and grinding are discharged out of the well through circulation to form the full-bore casing.

An existing bridge plug has upper and lower slip anchoring mechanisms and a sealing rubber barrel and thus a complex structure. An existing ball seat usually has a cone, a sealing element (such as a rubber barrel or a sealing ring), a slip and a lower joint. As shown in FIG. 1, the existing ball seat or frac plug includes a cone 1, a sealing ring 2, a slip 3 and a lower joint 4. An outer wall of the cone 1 is a conical surface and an axial channel is formed in the cone 1. The sealing ring 2 and the slip 3 sequentially casing the cone 1 from left to right. A left end of the slip 3 abuts against a right end of the sealing ring 2. A left end of the lower joint 4 abuts against a right end of the slip 3.

The above ball seat or frac plug has the following disadvantages: many structural members result in relatively complex processing of the ball seat; and the ball seat or frac plug is relatively long due to many structural members, and this makes it difficult to dissolve the ball seat in the well or drill the ball seat or frac plug in the well and then remove the processed ball seat or the frac plug from the well, resulting in many downhole residues and high possibility of plugging the downhole casing. In addition, because the cone 1, the sealing ring 2 and the slip 3 all have certain thickness, the ball seat or frac plug has a relatively smaller internal channel, which is unfavorable to the flowback of a well fluid. Moreover, since the above slip 3 and sealing ring 2 are formed separately and are respectively configured to anchor and seal the ball seat or frac plug, the structure is complex and the cost is higher.

When the above ball seat or frac plug is used, it needs to use a setting tool. In the prior art, an energized release device is mostly used as the setting tool for the above ball seat or frac plug. As shown in FIG. 2, the energized release device includes a cylindrical hollow pushing barrel 5. A right end of the pushing barrel 5 is connected with a left end of a setting barrel 8, and a right end of the setting barrel 8 abuts against an end surface of the cone 1 of the above ball seat or frac plug. An adapter joint 6 and a release lever 7 are axially disposed in the pushing barrel 5. One end of the release lever 7 is connected with one end of the adapter joint 6, and the other end of the release lever 7 is connected with the lower joint 4 after passing through the cone 1, the sealing ring 2 and the slip 3 of the above ball seat.

The above energized release device has the following advantages. Since the setting barrel 8 directly abuts against an end surface of a cone bottom of the cone 1 of the ball seat, it cannot support an inner wall of the cone 1, i.e., cannot support the sealing ring 2 and the slip 3. When the setting barrel 8 has too large axial thrust to the cone 1, the cone 1 may be damaged, and further the cone 1 cannot limit and support the sealing ring 2 and the slip 3, resulting in possible damage to the sealing ring 2 and the slip 3 and thus adverse effect on setting of the ball seat.

When the above energized release device is used for setting the above ball seat on the inner wall of the downhole casing, firstly, the release lever 7 passes through the cone 1, the sealing ring 2, and the slip 3 of the ball seat, and an end, away from the adapter joint 6, of a connector is connected with the lower joint 4; secondly, the setting barrel 8 is adjusted such that an end, close to the ball seat, of the setting barrel 8 abuts against an end surface of a cone top of the cone 1; then a pulling force towards the outside of the well is applied to the release lever 7 through the adapter joint 6 and at the same time thrust towards the inside of the well is applied to the cone 1 through the setting barrel 8, so that the slip 3 and the sealing ring 2 move from the cone top of the cone 1 to the cone bottom thereof until an outer wall of the sealing ring 2 is tightly attached to an inner wall of the casing and slip teeth on an outer wall of the slip 3 are anchored to the inner wall of the casing; and finally, by increasing the pulling force to the release lever 7 by the adapter joint 6, the lower joint 4 is separated from the release lever 7, and thus the entire setting tool is pulled out of the well and only the cone 1, the sealing ring 2, the slip 3 and the lower joint 4 remain in the well.

An existing downhole setting system has the following disadvantages when it achieves the downhole setting using the above ball seat and the energized release device. The total length is relatively larger due to many members left in the well, so that downhole dissolution or downhole drilling and then removal from the well is/are difficult, resulting in many downhole residues and high possibility of plugging the downhole casing. In addition, oil well construction is adversely affected by the dissolution or removal rate of the ball seat or high difficulty in removal of the ball seat from the well, so that the oil well cannot be put into production punctually and the construction cost increases. Moreover, a relatively smaller internal channel of the ball seat does not contribute to the flowback of the well fluid and adversely affects the construction.

SUMMARY

In order to achieve the above objects, the present disclosure adopts the following technical solutions. In a first aspect, a integrated collet includes a collet body, wherein the collet body forms a seal with an inner wall of a downhole casing and is anchored thereto; an internal channel is provided inside the collet body along its axial direction; and an inner wall of the internal channel of the collet body is of conical shape.

In a second aspect, the present disclosure further provides a downhole plugging system includes the integrated collet and a plugging body. The plugging body includes a plugging section provided with a support section thereon; the support section is of a hollow structure with a closed end; an outer wall of the support section is a conical plugging body surface; the closed end is located at a first end, with relatively smaller diameter, of a cone formed by the conical plugging body surface; and the conical collet surface and the conical plugging body surface matches each other and form a seal.

In a second aspect, the present disclosure further provides a plugging method includes at least the following steps: inserting a plugging section of the plugging body into the integrated collet that is already set, abutting an outer wall of the plugging section against the inner wall of the integrated collet, and plugging the internal channel of the integrated collet by the plugging section, thereby completing a downhole plugging.

BRIEF DESCRIPTION OF DRAWINGS

FIG. 4 is a front view of the integrated collet according to one or more embodiments, wherein.

Figure 1:
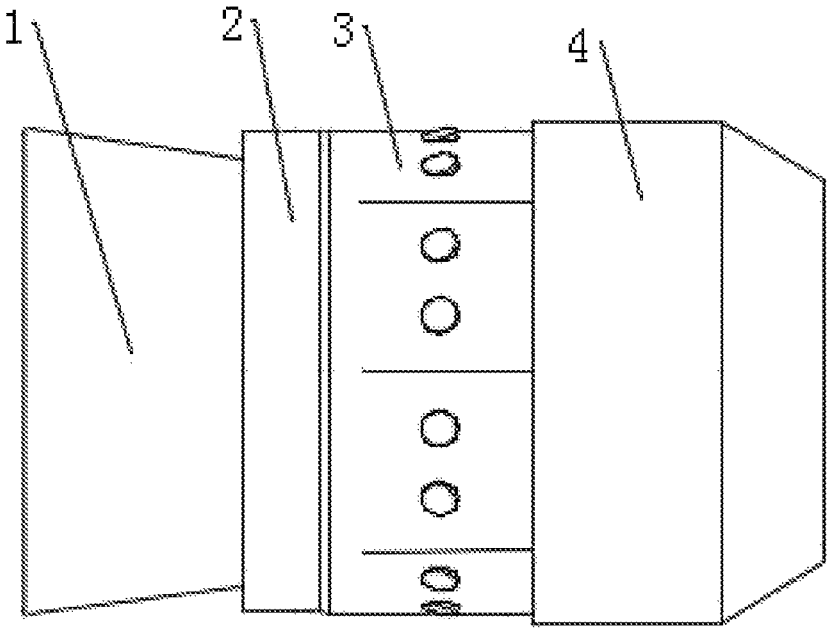
FIG. 1 (Prior Art)
FIG. 1 is a structural diagram of a ball seat in the prior art.
Figure 2:
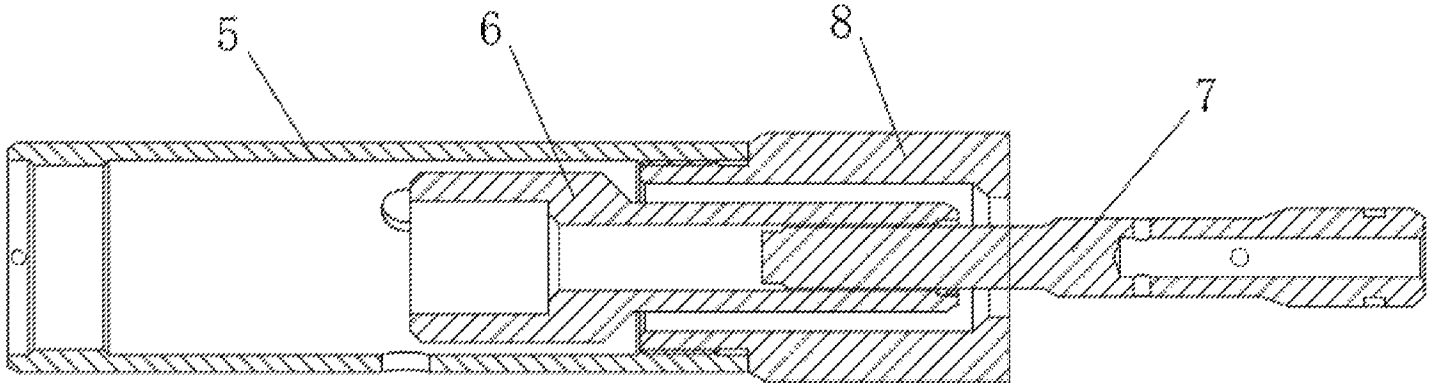
FIG. 2 (PRIOR ART)
FIG. 2 is a structural diagram of an expansion release device in the prior art.

Reference signs: 1—cone; 2—sealing ring; 3—slip; 4—lower joint; 5—pushing barrel; 6—adapter joint; 7—release lever; and 8—setting barrel; 21—rubber gasket ring; 23—collet body; 3—slip; 31—slip bowl; 311—toothed plate; 32—slip tooth; 33—gap; 331—gap bottom; 332—gap neck; 4—lower joint; 5—pushing barrel; 6—adapter joint; 7—release lever; 8—setting barrel; 9—plugging section; 91—support section; 911—groove; 92—guide section; 10—straight barrel section; 101—end cap.

DESCRIPTION OF EMBODIMENTS

The present disclosure will be illustrated in detail below with reference to the accompanying drawings.

An object of the present disclosure is to provide an integrated collet of a slip and a sealing ring, that addresses problems presented in the prior art, namely, the slip and the sealing ring are formed separately and configured for anchoring and sealing a ball seat respectively, complicated structure, and, relatively high cost. The integrated collet is able to perform simultaneously functions of sealing and anchoring, therefore set the ball seat. Moreover, it is simple in structure and convenient for the setting operation of the ball seat thus has an extremely high practical value and improved cost-efficiency.

Another object of the present disclosure is to provide a clamping seat, that addresses problems presented in the prior art ball seat or frac plug, of which excessive numbers of parts lead to complicated manufacturing processing, and difficulties in dissolving it or drilling or removing the same in a well, thus result in excessive downhole residues and are prone to blockages in downhole casing or casing; and, a relatively limited diameter of internal channel of the prior art ball seat also fail to facilitate a well fluid's flowback.

A further object of the present disclosure is to provide a retrievable expansion cone, addresses problems presented in a prior art expansion release device that since a setting barrel of the prior art expansion release device directly abuts against an end surface of a cone bottom of a cone of the ball seat and cannot support an inner wall of the cone, i.e., cannot support a sealing ring and a slip, when the setting barrel has too large axial thrust to the cone, the cone may be damaged, therefore the cone cannot limit and support the sealing ring and the slip, resulting in possible damage to the sealing ring and the slip and thus adverse effect on setting of the ball seat, A further object of the present disclosure is to provide a downhole setting system and a setting method, that addresses problems presented in a prior art downhole setting system having aforementioned prior art ball seat and prior art expansion release device: namely, excessive parts and length of downhole residues that lead to difficulties in dissolving or drilling and removing them in the downhole, and cause dissolution or downhole drilling and then removal from the well is/are difficult, resulting in the blockages therein; oil well construction is adversely affected by the dissolution or removal rate of the prior art ball seat or high difficulty in removal of the same from the well, so that the oil well's production is delayed and the costs thereof is increased; and, the relatively limited diameter of internal channel of the prior art ball seat also fail to facilitate the well fluid's flowback. In addition, the prior art downhole setting system may cause premature setting, due to its excessive part numbers and length. In comparison, the integrated collet of the present disclosure consists of one integrated part, therefore, it prevents premature setting of the downhole setting system.

In order to make the objectives, technical solutions and advantages of the present disclosure clearer, the present disclosure is further illustrated in detail below with reference to the accompanying drawings and embodiments. It should be understood that specific embodiments described herein are only intended to explain the present disclosure instead of limiting the present disclosure.

Figure 3:
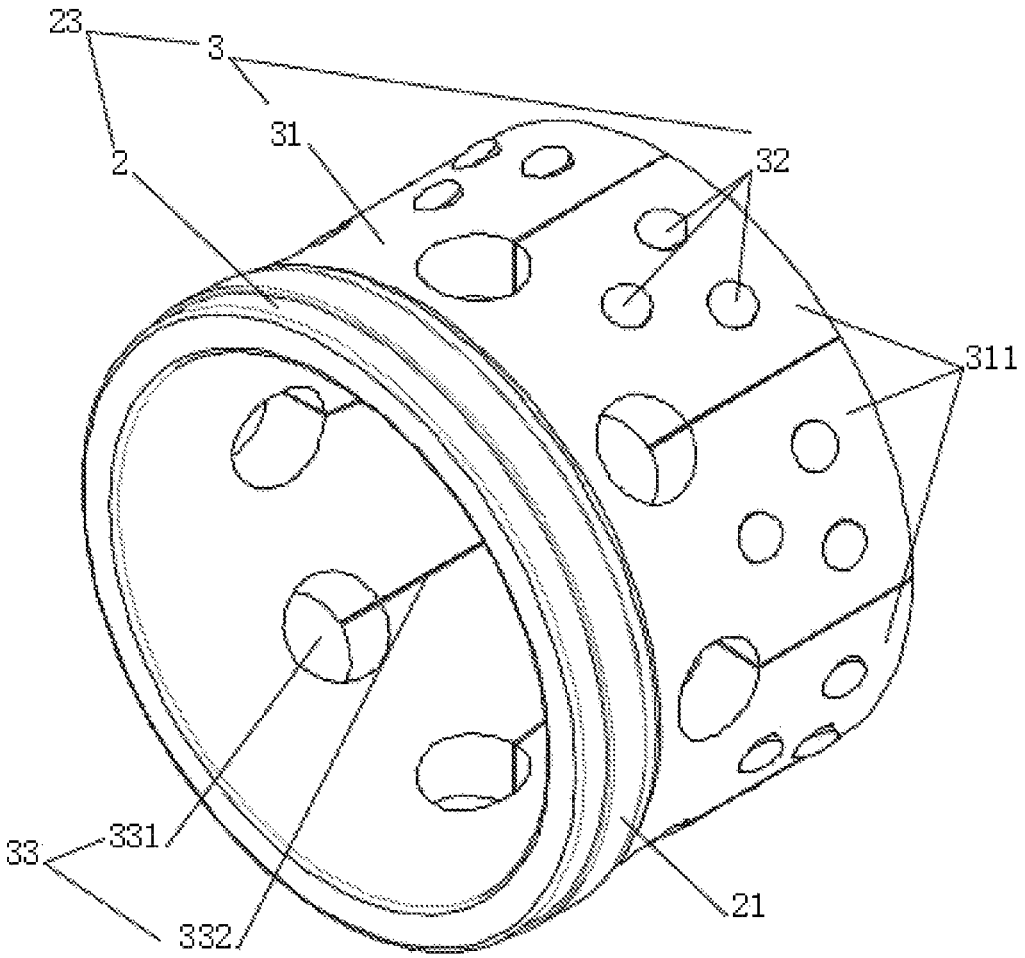
FIG. 3 is a structural diagram of an integrated collet according to one or more embodiments.
Figure 4A:
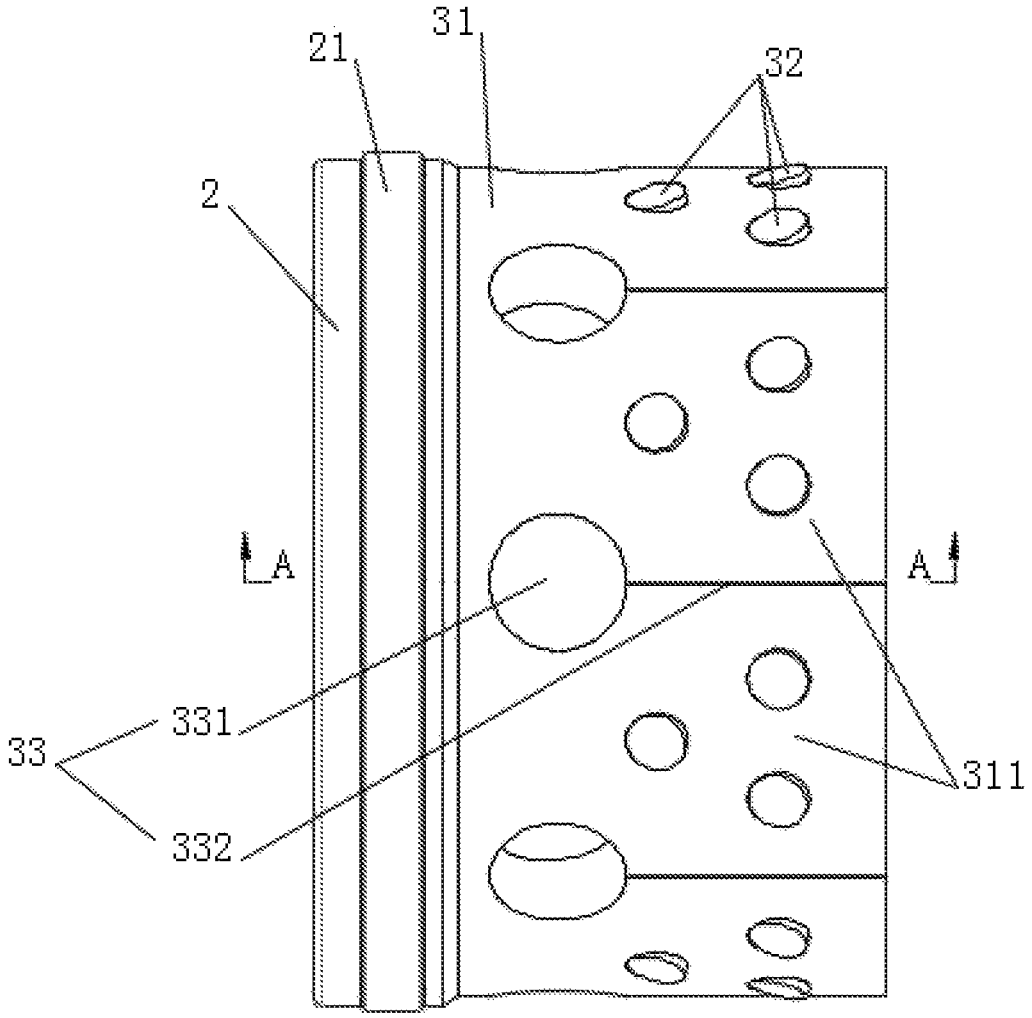
FIG. 4A is a front view of the integrated collet with circular holes.
Figure 4B:
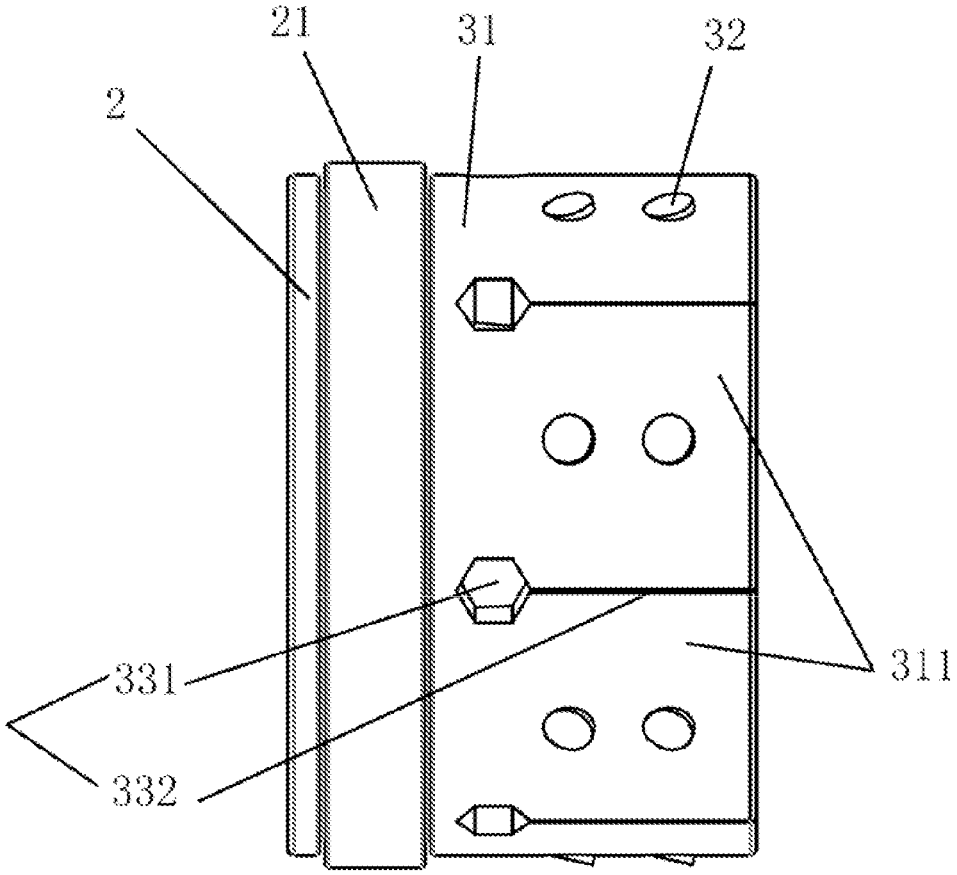
FIG. 4B is a front view of the integrated collet with polygonal holes.
Figure 4C:
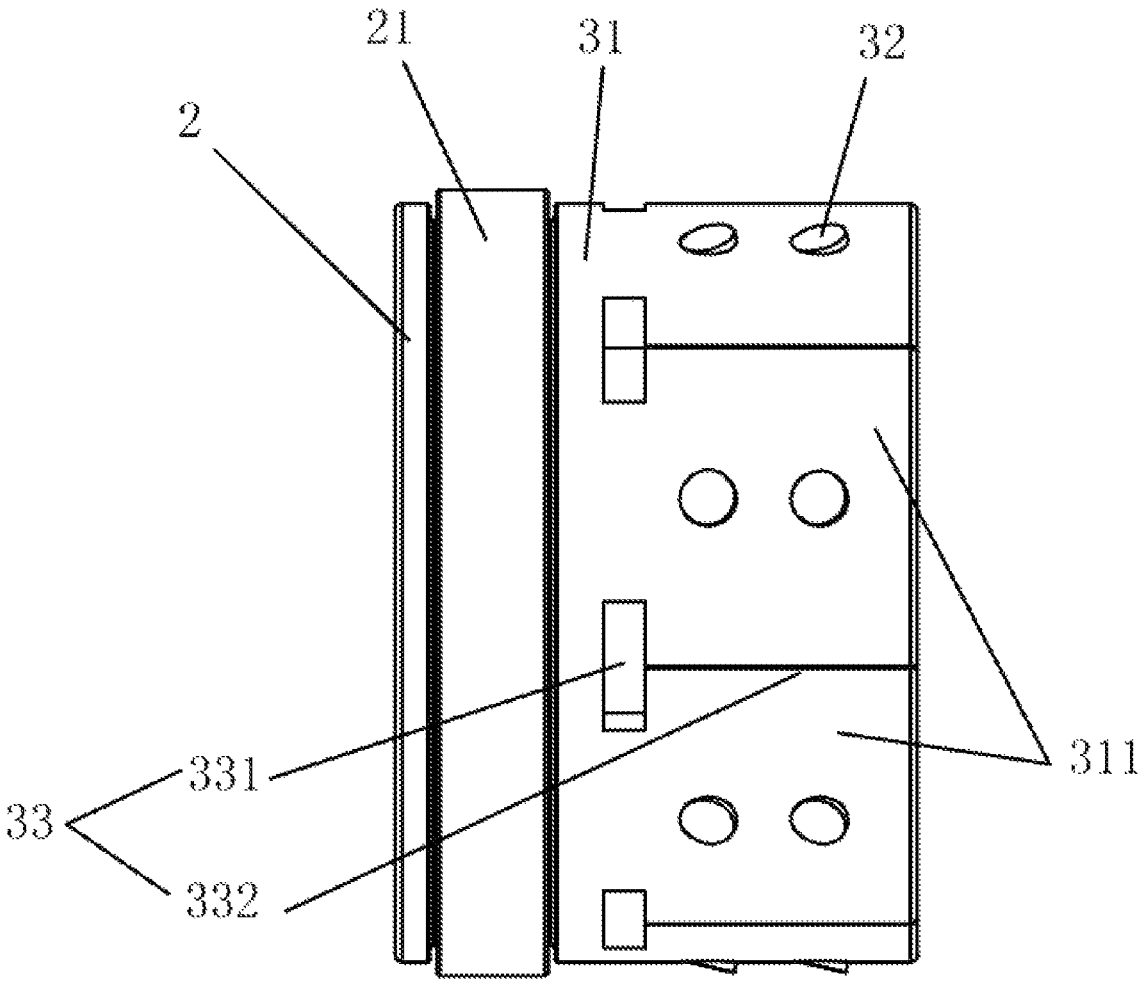
FIG. 4C is a front view of the integrated collet with oblong holes.
Figure 4D:
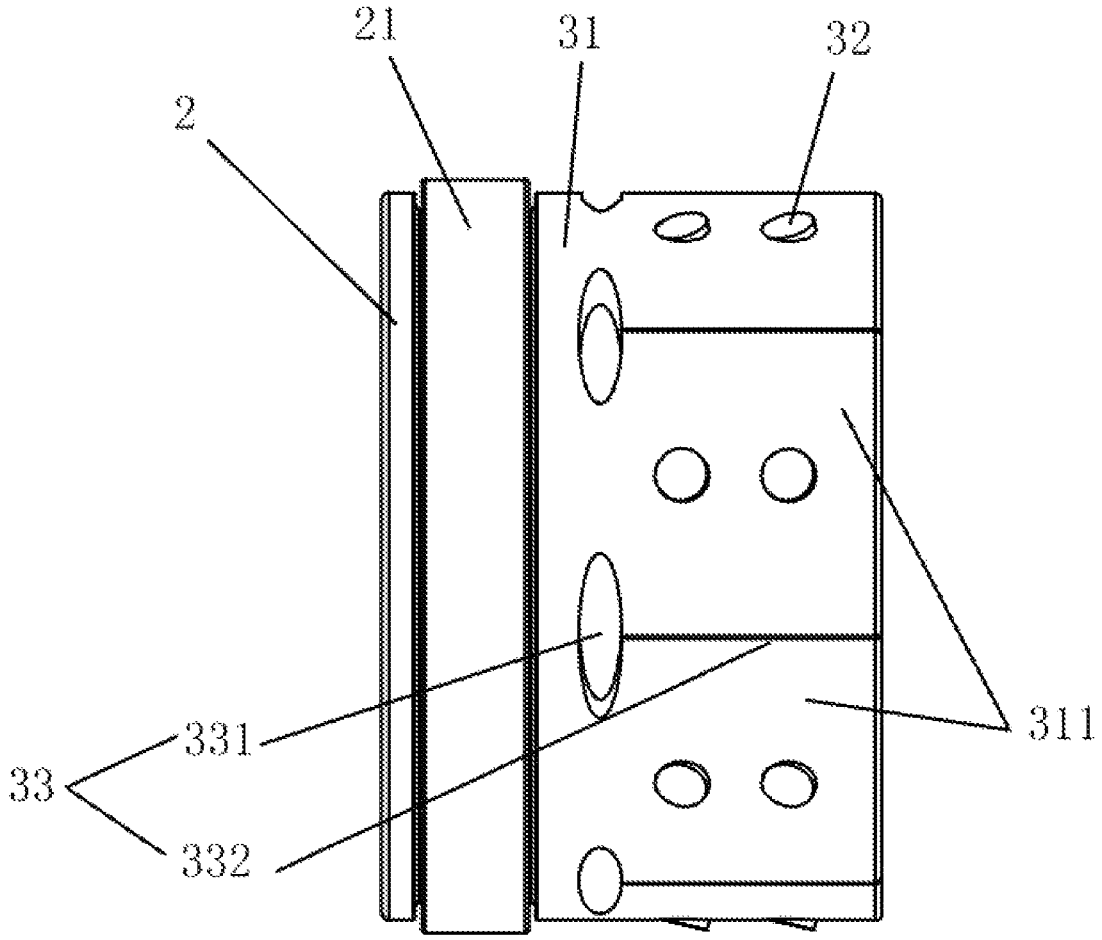
FIG. 4D is a front view of the integrated collet with elliptical holes.
Figure 5:
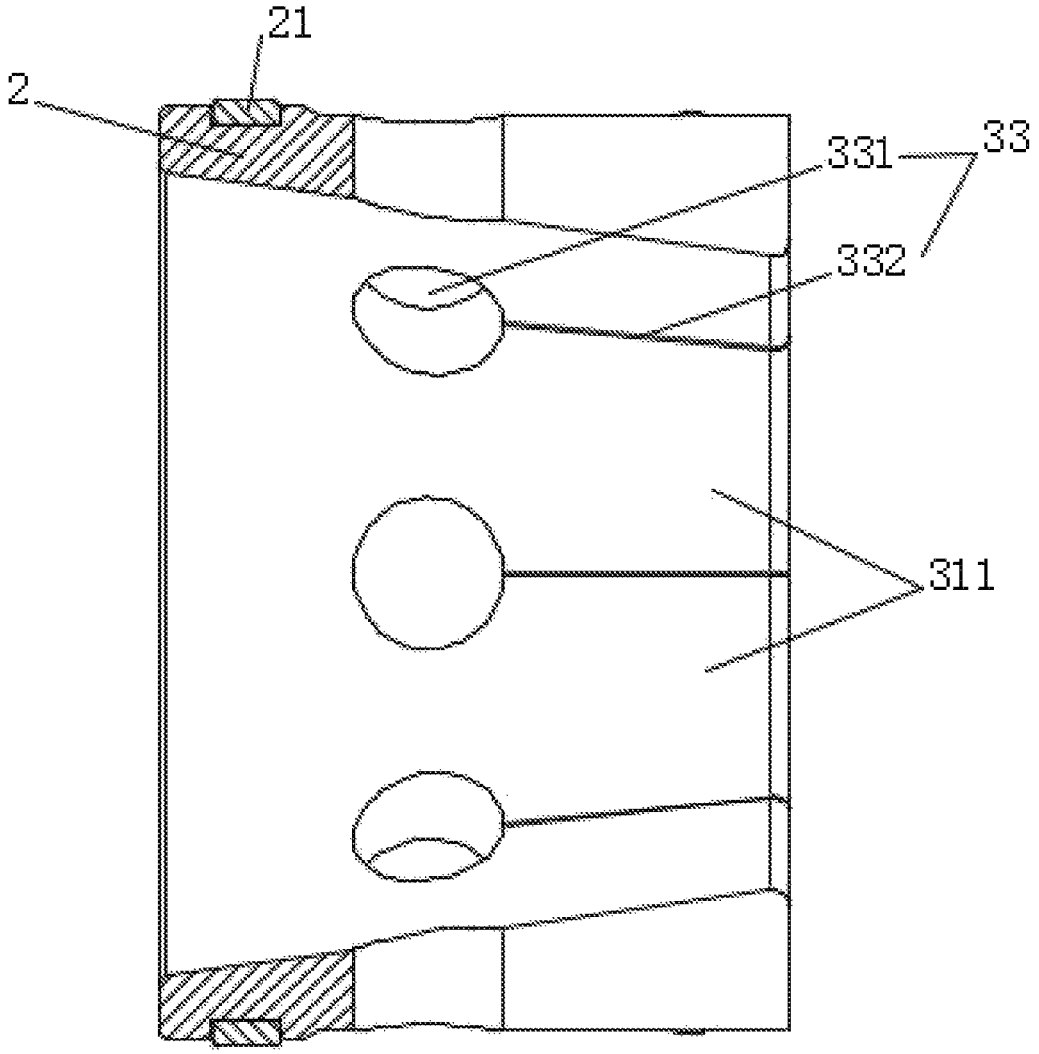
FIG. 5 is a sectional view at A-A in FIG. 4.
Figure 6:
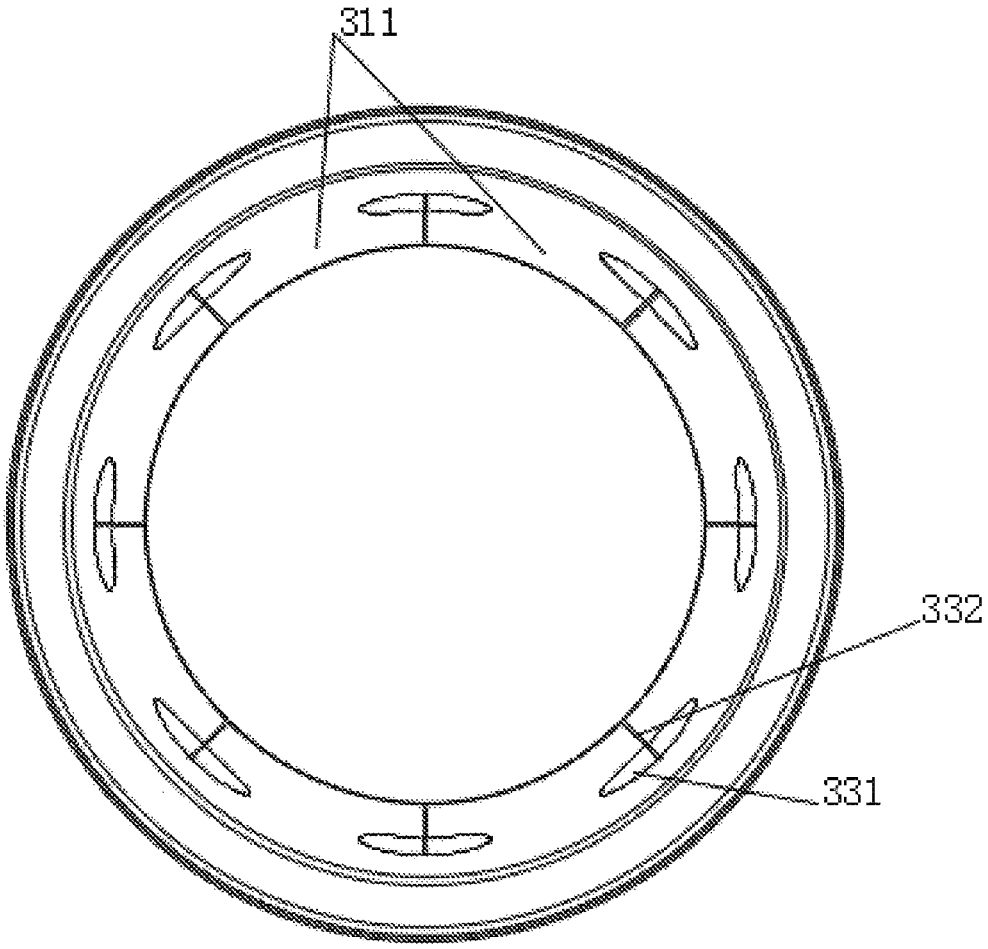
FIG. 6 is a left view of the integrated collet according to one or more embodiments.

In one embodiment, it provides an integrated collet. As shown in FIGS. 3-6, the integrated collet includes a collet body 23. According to one embodiment, FIG. 3 is a structural diagram of the integrated collet, FIG. 4 is a front view of the integrated collet according, FIG. 5 is a sectional view at A-A in FIG. 4, and FIG. 6 is a left view of the integrated collet. The collet body 23 forms a seal with an inner wall of a downhole casing, and is anchored to an inner wall of a downhole casing. An internal channel is formed inside the collet body 23 along its axial direction. An inner wall of the internal channel of the collet body 23 is of a conical surface.

Figure 10:
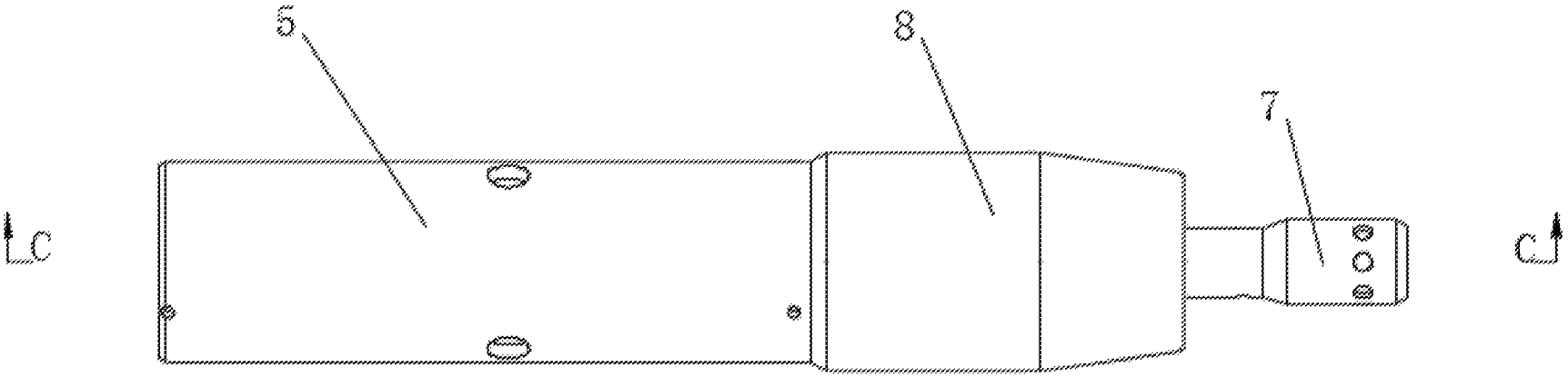
FIG. 10 is a front view of a retrievable expansion cone according to one or more embodiments.
Figure 11:
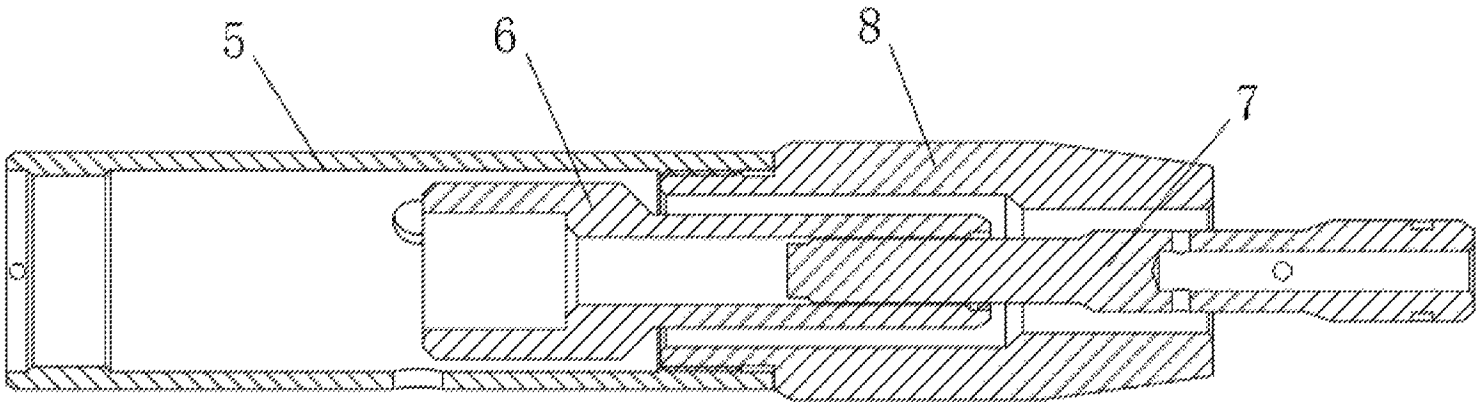
FIG. 11 is a sectional view at C-C in FIG. 10.
Figure 12:
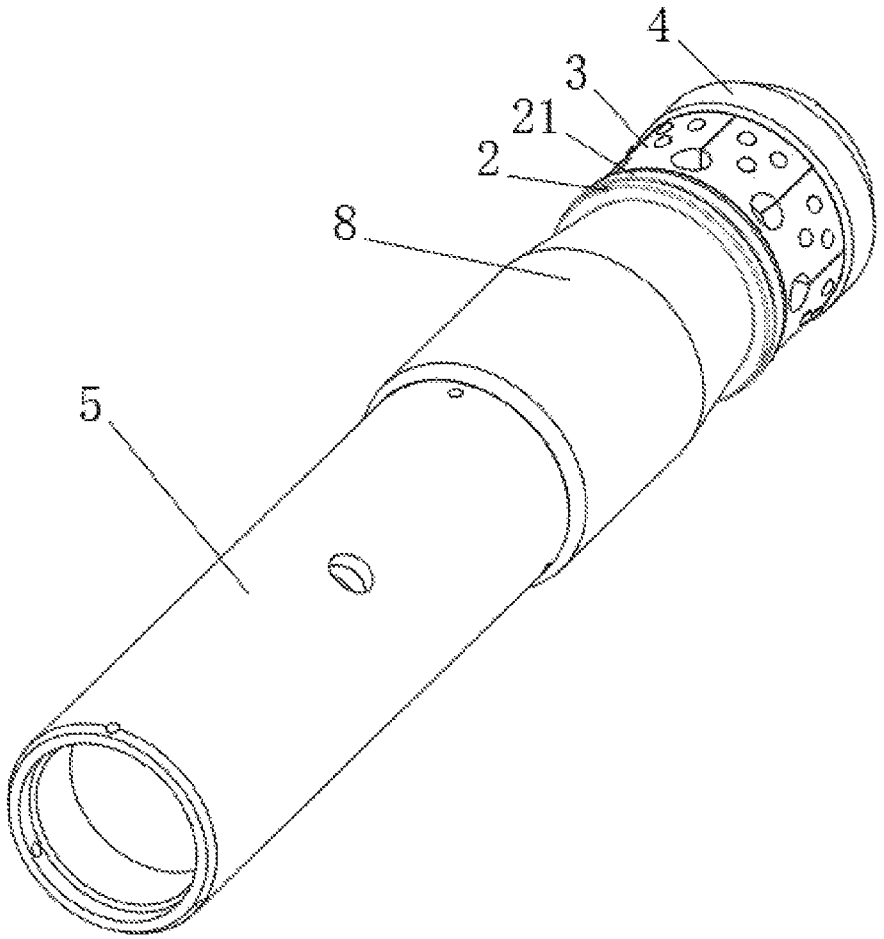
FIG. 12 is a stereoscopic structural diagram of a setting system according to one or more embodiments.
Figure 13:
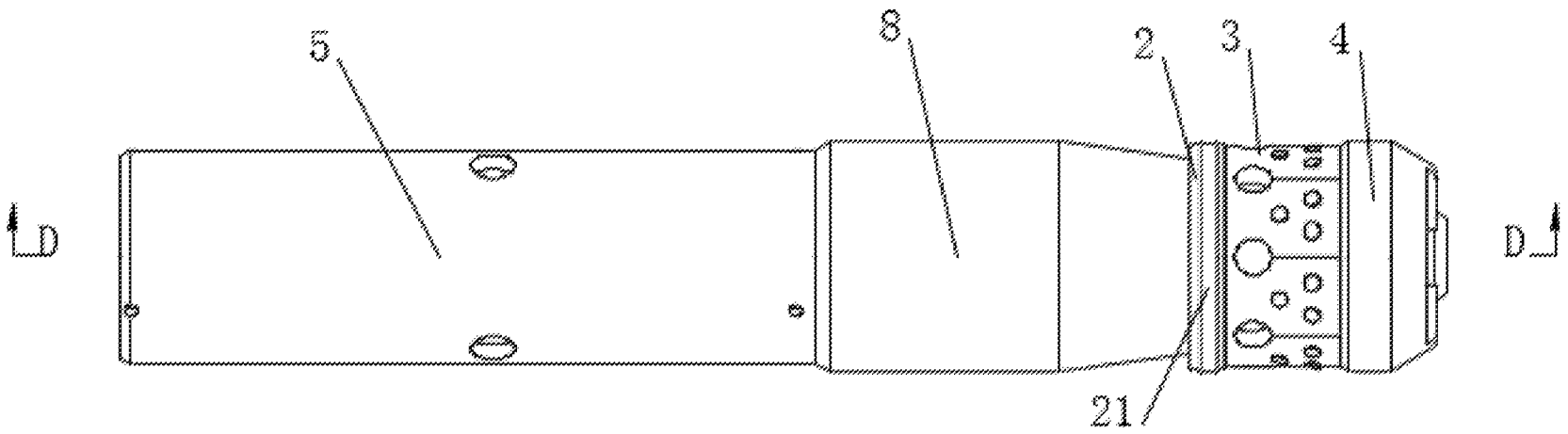
FIG. 13 is a front view of the setting system according to one or more embodiments.
Figure 14:
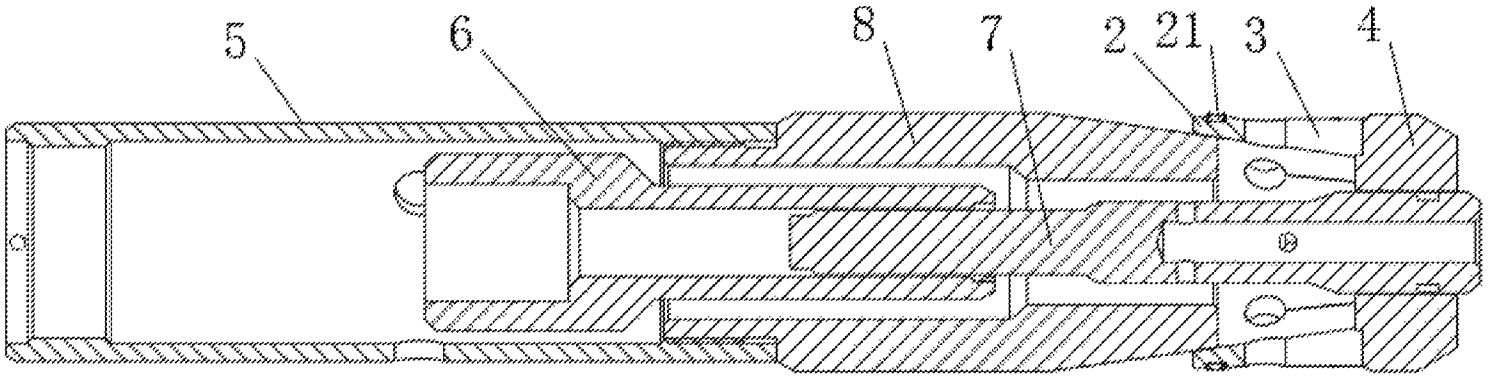
FIG. 14 is a sectional view at D-D in FIG. 13.

The collet body 23 has a sealing function and an anchoring function and is configured to set in the casing. In this embodiment, as shown in FIGS. 12-14, the collet can cooperate with a lower joint 4 and a setting tool of the ball seat to achieve the setting of the ball seat. That is, the collet body 23 can form the seal with the inner wall of the downhole casing and at the same time anchor itself thereto. The inner wall of the collet body being the conical surface means that inner diameters of the collet body 23 gradually decrease from a first end, that is away from the lower joint 4, of the collet body 23 to a second end thereof. The conicity of the conical surface may be set within 5°-30°. The collet body 23 is a plastically deformable member which can retain its shape after expansion and deformation under forces, instead of returning to its original shape. An inner wall of the plastically deformable member is a conical surface, and slip teeth 32 are disposed on an outer wall of the plastically deformable member. By squeezing two ends of the plastically deformable member with a setting tool which has a conical member capable of extending into the plastically deformable member for supporting, the plastically deformable member expands and deforms outwardly and radially to achieve sealing. At the same time, the slip teeth 32 anchor the collet body 23 to the inner wall of the casing to achieve setting. A retrievable expansion cone as shown in FIGS. 10 and 11 may be used as the setting tool, wherein FIG. 10 is a front view of the retrievable expansion cone according to one or more embodiments, and FIG. 11 is a sectional view at C-C in FIG. 10.

In this embodiment, with reference to FIGS. 3-5, the collet body 23 includes a sealing ring 2 and a slip 3. The slip 3 includes a slip bowl 31 and a plurality of slip teeth 32. Both the slip bowl 31 and the sealing ring 2 are plastically deformable members and are integrated into one piece to form an integrated member. The sealing ring 2 is arranged at a first end of the slip bowl 31, and a plurality of toothed plates 311 are arranged at a second end of the slip bowl 31; and a gap 33 exists between two adjacent toothed plates 311 and is disposed along an axial direction of the slip bowl 31. The plastically deformable member can retain its shape after being subjected to expansion deformation, instead of returning to its original shape, thereby ensuring that the collet body 23 can maintain a stable seal with the inner wall of the casing. With two end surfaces of the collet body 23 squeezed by opposite acting forces respectively, both the sealing ring 2 and the slip bowl 31 are subjected to expansion deformation due to squeezing until an outer wall of the sealing ring 2 is tightly attached to the inner wall of the downhole casing to achieve the sealing function of the collet body 23. At the same time, the slip teeth 32 of the slip 3 anchor the collet body 23 to the inner wall of the downhole casing to complete the setting. As a preferred embodiment, the sealing ring 2 is provided with at least one lap of O-ring or rubber gasket ring. Both the O-ring and the rubber gasket ring are configured for assisting in sealing. In this embodiment, the rubber gasket ring 21 is taken as an example. In a setting process, the rubber gasket ring 21 forms an initial seal with the inner wall of the casing. Upon completion of the setting, the rubber gasket ring 21 and the sealing ring 2 themselves form a double seal.

Specifically, both the sealing ring 2 and the slip bowl 31 are members with an elongation rate between 14% and 40%. The sealing ring 2 and the slip bowl 31, which may be made of metal, non-metal or composite, ensure their plastic deformation, prevent the sealing ring 2 from returning to its original shape after being deformed, and also ensure that the slip 3 anchor the sealing ring 2 at a specified position. For example, the aforementioned parts may have made of a metal with high elongation rate. In this embodiment, both the slip bowl 31 and the sealing ring 2 are made of magnesium alloy. In yet another embodiment, other soluble metals, of which the elongation rate is between 14%-40%, may be used. The soluble metal refers to such a metal that can be dissolved in a liquid having corresponding salinity.

As shown in FIG. 4 or 6, the slip bowl 31 is provided with eight toothed plates 311 at its right end. Three slip tooth grooves are formed in each toothed plate 311. All the slip tooth grooves in each toothed plate 311 are axially disposed along the slip bowl 31 and arranged in a triangular pattern. One piece of a slip tooth 32 is disposed in each slip tooth groove. The slip tooth 32 is of a cylindrical structure, and an included angle between an outer end surface of the slip tooth 32 and an axial line of the slip bowl 31 is 10-60°. The outer end surface of the slip tooth 32 faces away from the first end of the slip bowl 31, at which the tooth plate 311 is disposed. The outer end surface refers to a surface, facing a groove bottom surface of the slip tooth groove, on the slip tooth 32. This surface forms the included angle with the axial line of the slip bowl 31, therefore forms an inclined surface. As such, a contact area between the slip tooth 32 and the casing is reduced, and the capability of the slip tooth 32 to squeeze into the casing is increased, so that the soluble integrated slip 3 has a better anchoring capability. Of course, the number of the slip teeth 32 may vary according to the stress and design requirements. The slip tooth grooves are uniformly formed in the toothed plates 311, namely, the slip teeth 32 are uniformly disposed on the toothed plates 311. As such, when the toothed plates 311 are opened under force, the slip teeth 32 can better anchor to the casing, and thus the slip 3 has a better anchoring effect.

A gap 33 exists between each pair of two adjacent toothed plates 311 and is disposed along the axial direction of the slip bowl 31. Specifically, the gap 33 includes a gap bottom 331 and a gap neck 332. The gap bottom 331 is a stress hole which is an oblong hole, a regularly polygonal hole, an elliptical hole or a circular hole. In this embodiment, the stress hole is the circular hole. The gap neck 332 is a strip-shaped groove. The circular stress hole is communicated with an opening in a left end of the strip-shaped groove. An opening in a right end of the strip-shaped groove is formed in its end close to the lower joint 4. The gap neck 332 has a width less than that of the gap bottom 331. Specifically, the gap neck 332 has a width of 3 mm-5 mm, and the gap bottom 331 has a width which is 3 to 5 times the width of the gap neck 332.

The integrated collet according to this embodiment adopts an integrated structure of the slip 3 and the sealing ring 2. The sealing ring 2 and the slip bowl 31 of the slip 3 are the plastically deformable members. The sealing ring 2 and the slip bowl 31 are the integrated member, can synchronously undergo expansion deformation without returning to their original shape, therefore achieve the sealing function and the anchoring function of a prior art ball seat, and facilitate the setting of the ball seat. Compared with the prior art ball seat which achieves the sealing and anchoring depending on two separate parts respectively, i.e., the sealing ring 2 and the slip 3, the integrated collet has a simpler structure and is convenient for the setting operation of the ball seat. Meanwhile, the integrated collet of the present disclosure has fewer structural components as it does not require a cone such as a mandrel, can directly realize the setting function, and thus has improved reliability and an extremely high practical value. In addition, the integrated collet has higher convenience in processing and cost performance.

When a prior art commonly-used downhole plugging tool, such as a bridge plug and a ball seat, is used for plugging the downhole casing, since the downhole tool has many components including a cone, the overall length of the downhole tool left in the casing is approximately 200 mm to 500 mm after downhole setting, and this overall length is relatively large. By contrast, when the collet of the present disclosure is used for plugging the downhole casing, the overall length of the collet reserved in the casing is approximately 25 mm to 70 mm after downhole setting, which is shortened by 80% comparing with that of the prior art downhole tool.

In an embodiment, when the stress holes are the oblong holes, the oblong hole in its length direction is perpendicular to the axial direction of the collet body 23.

Since the stress hole in the slip is the oblong hole and the oblong hole is set longer to release the stress in a circumferential direction of the slip, the stress of the slip at a connection position between the slip and the sealing ring will be released more sufficiently. Thus, the sealing effect of the sealing ring is not affected and it is easy to open the slip by fracturing without generating stress, thereby improving the reliability of the slip. Moreover, as each of the holes is strip-shaped and will not occupy a significant area of the entire slip, the strength of the slip is basically not affected. Furthermore, two long side of the oblong hole are parallel to each other, and after the setting is completed, a plugging function is realized by feeding a plugging body into the inner surface of the collet. After the casing is plugged and one end of the slip is stressed, the two long sides of the oblong hole are parallel and close to each other and thus are squeezed together. As such, the slip has a good supporting effect on the sealing ring, and the sealing ring will have excellent sealing reliability.

In an embodiment, when each of the stress holes is the polygonal hole, the polygonal hole forms an elongated hole in the circumferential direction of the collet body 23 and is perpendicular to the axial direction of the collet body 23, and two long sides of the elongated hole are parallel to each other.

Since the stress hole is the polygonal hole and forms the elongated hole in the circumferential direction which is set longer to release the stress in the circumferential direction of the slip, the stress of the slip at the connection position between the slip and the sealing ring will be released more sufficiently. Preferably, a combined length in the circumferential direction of all the elongated holes is equal to or greater than ½ of a perimeter of the integrated collet. Thus, the sealing effect of the sealing ring is not affected and it is easy to open the slip by fracturing without generating stress, thereby improving the reliability of the slip. Moreover, as the hole is strip-shaped and will not occupy a significant area of the entire slip, the strength of the slip is basically not affected. Furthermore, after the setting is completed, a plugging function is realized by feeding a plugging body into the inner surface of the collet. After the casing is plugged and one end of the slip is stressed, two long sides of the elongated hole are parallel and close to each other and thus are squeezed together. As such, the slip has a good supporting effect on the sealing ring, and the sealing ring will have excellent sealing reliability.

In yet another embodiment, each of the stress holes of the gap bottom 331 is a circumferential slotted hole which is in the circumferential direction of the collet and which is perpendicular to the axial line of the collet. The circumferential slotted hole refers to such a hole that has a relatively larger length and a relatively smaller width. The gap neck 332 between the two toothed plates 311 may not be communicated with the gap bottom 331 of the stress hole or the second end of the slip bowl.

For example, the gap neck 332 on the slip 3 is disposed at a middle portion of the slip 3 and is not communicated with the gap bottom 331 and an end surface of a second end or a right end of the slip 3. Such an arrangement allows the slip 3 to keep integrity during opening under force.

Or the gap neck 332 on the slip 3 is communicated with the gap bottom 331. For collets made of different materials, gap necks 332 having different lengths are disposed for facilitating practical use of the collets.

Or the gap neck 332 runs through the end surface of the second end of the slip 3. The slip teeth 32 are close to the end of the slip 3, and the gap neck 332 runs through the end surface of the other end of the slip 3. As such, when the slip 3 is opened under force, the slip teeth 32 here initiate anchoring to the inner wall of the casing.

Or the gap neck 332 is a rectangular groove. Two long sides of the rectangular groove are parallel to each other and there is no rounded corner at four corners, so that the stress release area of the slip is further increased.

In yet another embodiment, the gap bottom 331 and the sealing ring 2 are spaced apart to ensure that the slip 3 will not adversely affect the sealing ring 2 when opened by fracturing, and will not generate stress to the sealing ring 2, therefore ensures the reliability of the sealing ring 2.

Figure 7:
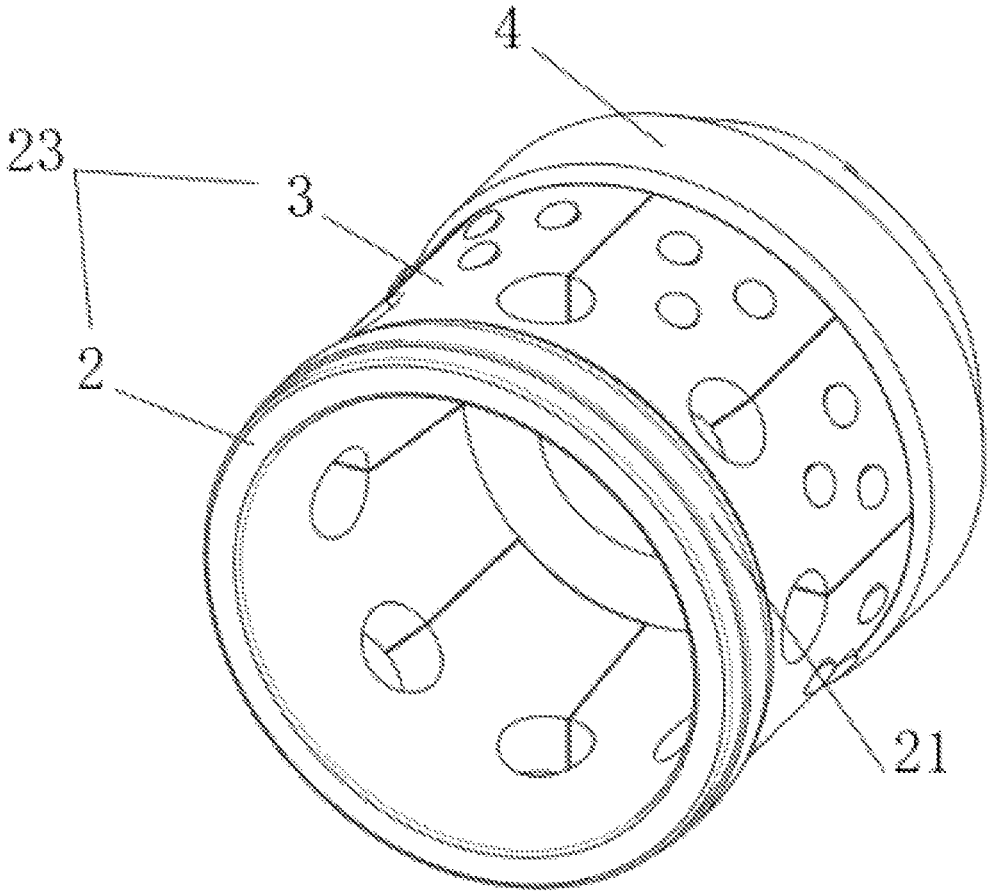
FIG. 7 is a stereoscopic structural diagram of a clamping seat according to one or more embodiments.
Figure 8:
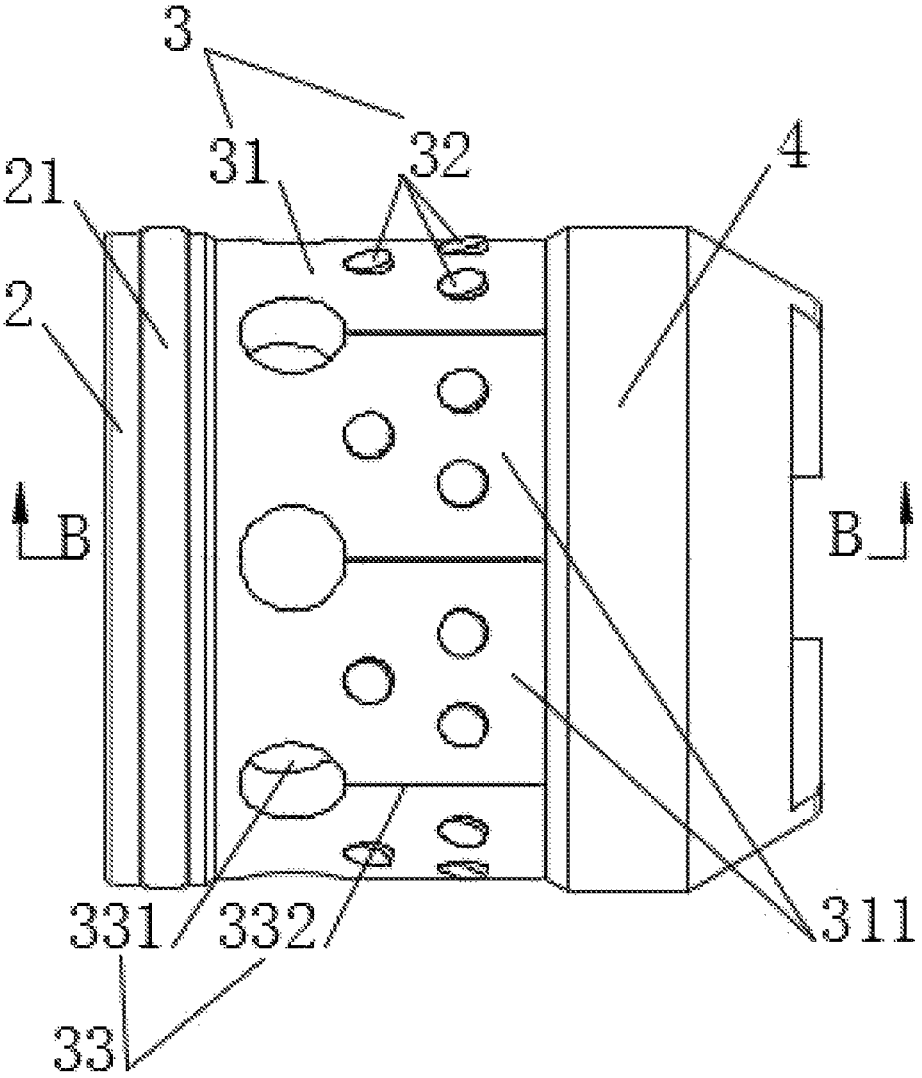
FIG. 8 is a front view of the clamping seat according to one or more embodiments.
Figure 9:
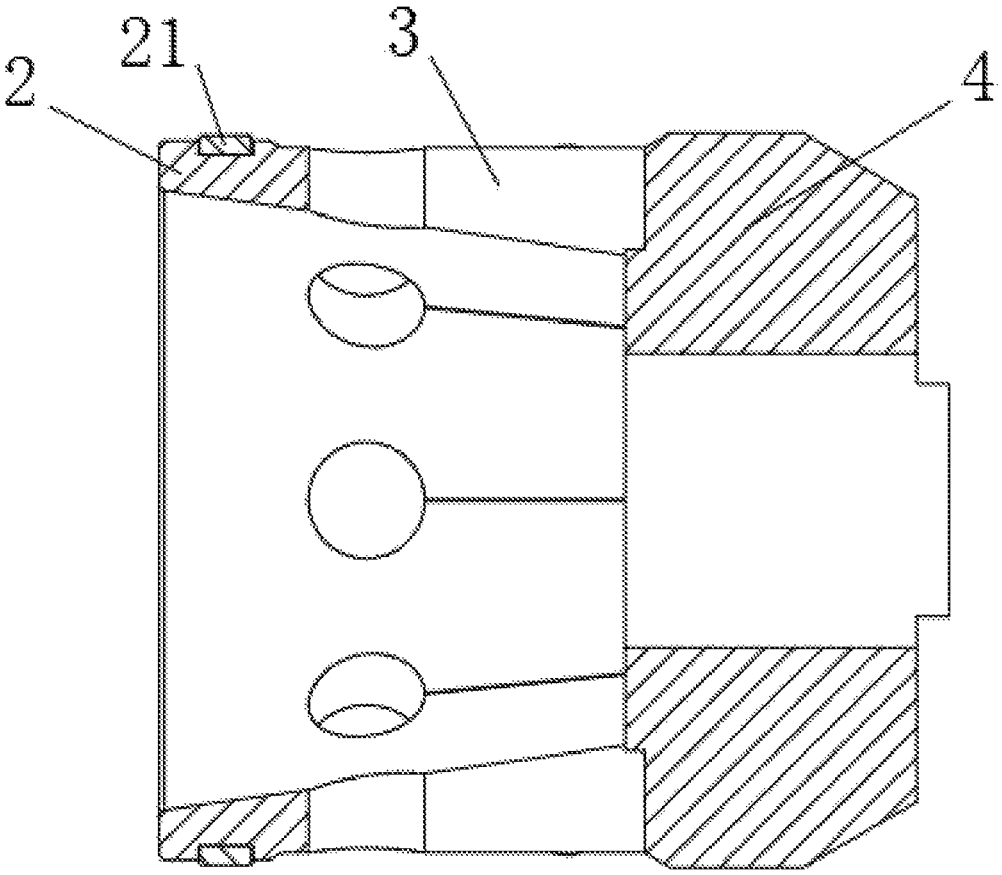
FIG. 9 is a sectional view at B-B in FIG. 8.

Another embodiment of the disclosure provides a clamping seat which has the same function and similar structure as that of the prior art ball seat. As shown in FIGS. 7-9, the clamping seat includes the lower joint 4 and the integrated collet according to one embodiment of the disclosure, where FIG. 7 is a stereoscopic structural diagram of the clamping seat; FIG. 8 is a front view of the clamping seat; and, FIG. 9 is a sectional view at B-B in FIG. 8. The integrated collet includes the collet body 23 which can form the seal with the inner wall of the downhole casing and is anchored to the inner wall of the downhole casing. The collet body 23 is internally provided with the channel along the axial direction, and the lower joint 4 is internally provided with a channel along its axial direction. The collet body 23 is disposed at a first end of the lower joint 4, and the internal channel of the lower joint 4 is communicated with the internal channel of the collet body 23.

In this embodiment, as shown in FIG. 8, the collet body 23 includes the sealing ring 2 and the slip 3. The slip 3 includes the slip bowl 31 and a plurality of slip teeth 32. Both the slip bowl 31 and the sealing ring 2 are plastically deformable members and are an integrated member. The sealing ring 2 is arranged at the left end of the slip bowl 31, and a plurality of toothed plates 311 are arranged at the right end of the slip bowl 31. The gap 33 exists between two adjacent toothed plates 311 and is disposed along the axial direction of the slip bowl 31. A right end, at which the toothed plates 311 are disposed, of the collet body 23 is in contact with the first end of the lower joint 4. Specifically, the lower joint 4 is provided with a protrusion at the left end, which can be clamped into the internal channel of the collet body 23.

In this embodiment, the lower joint 4, the sealing ring 2, the slip bowl 31 and a fracturing ball are all made of a soluble material, an insoluble material or an insoluble composite material. In the process that a full-bore casing is formed after the clamping seat is set and subsequently plugged by a fracturing ball: as both the clamping seat and the fracturing ball are made of the soluble material, since the clamping seat has fewer parts comparing to the prior art ball seat, a dissolution time of the clamping seat is shortened, and there are less residues. When the clamping seat is made of the insoluble material or the insoluble composite material, it needs to be removed by drilling. Since the clamping seat has fewer parts comparing to the prior art ball seat, a drilling time of the clamping seat and the time spent in pulling or discharging the drilled clamping seat out of the well are shortened. Thus, the clamping seat can be conveniently removed from the well.

Specifically, in this embodiment, the soluble clamping seat is taken as an example. In this embodiment, the lower joint 4 of the clamping seat is made of the soluble metal, such as aluminum alloy or magnesium alloy, which can be dissolved in a liquid having corresponding salinity, or made of other soluble non-metal materials or soluble composite materials.

When the clamping seat according to this embodiment is used for setting, a retrievable expansion cone as shown in FIGS. 10 and 11 may be used. A setting barrel 8 of the retrievable expansion cone, instead of a cone structure of the prior art ball seat, provides support for the inner wall of the collet body 23. Therefore, an expansion deformation direction of the collet body 23 is limited, which ensures that the collet body 23 undergoes its outward expansion deformation radially. Thus, the outer wall of the collet body 23 attaches to the inner wall of the casing after the expansion. At the same time, the slip teeth 32 anchor to the inner wall of the casing, and thus, the collet body 23 is set at the specified position. Compared with the prior art ball seat which has the cone structure and the lower joint 4, the clamping seat according to this embodiment only has the lower joint, and can still be set on the inner wall of the casing with the integrated collet 23 having the anchoring function and the sealing function. In addition, the clamping seat has fewer parts, and thus can be manufactured effectively. Since the clamping seat has fewer parts, when the clamping seat is set in the downhole casing, the operation is more convenient, and relatively better safety and reliability are achieved. Fewer parts are left in the downhole casing, so that the subsequent formation of a full-bore casing is facilitated, therefore it provides a production-ready channel for oil and gas wells earlier. The material of the clamping seat is not limited. For example, when a soluble clamping seat is used, the dissolution time of the clamping seat in the process of forming the full-bore casing is relatively shortened and the time spent in forming the full-bore casing is shortened. When an insoluble clamping seat is used, it is convenient to remove the drilled clamping seat from the well, and the time spent in forming the full-bore casing is shortened. Thus, the oil well can be put into production punctually and the construction cost is reduced. Furthermore, the reduction in residues in the well prevents the casing from being blocked. In the case where the downhole casing has certain inner diameter, the clamping seat has a thinner wall and a larger internal channel since the cone structure is removed. As a result, the flowing and flowback of the well fluid are facilitated and the flowback efficiency of a fracturing fluid or impurities in the well is high.

This embodiment provides a retrievable expansion cone. As shown in FIGS. 10 and 11, the retrievable expansion cone is configured to set the clamping seat according to one or more embodiment and includes a pushing barrel 5 having its first end connected with a setting barrel 8. An outer wall of the first end, which is away from the pushing barrel 5, of the setting barrel 8 is adapted to abut against the inner wall of the collet body 23.

In this embodiment, the outer wall of the first end, configured to abut against the collet body 23, of the setting barrel 8 is a conical surface. The conical surface means that an outer diameter of the end, configured to abut against the collet body 23, of the setting barrel 8 gradually decreases from one end, close to the pushing barrel 5, to the second end of the setting barrel. The outer wall is adapted to the inner wall of the collet body 23, so that it is convenient for the setting barrel 8 to support the inner wall of the collet from an interior of the collet body 23, therefore limit the expansion deformation direction of the collet body 23, and meanwhile, providing an axial force for expansion deformation of the collet body 23.

The retrievable expansion cone further includes an adapter joint 6 and a release level 7 of a prior art expansion release device. The adapter joint 6 is disposed in the pushing barrel 5. A first end of the release lever 7 is connected with a first end of the adapter joint 6, and a second end of the release lever 7 is connected with the lower joint 4 after passing through the collet body 23 of the clamping seat.

The retrievable expansion cone according to this embodiment, the setting barrel 8 is disposed at a first end, which cooperates with the clamping seat, of the pushing barrel 5, and the outer wall of the first end, away from the pushing barrel 5, of the setting barrel 8 is adapted to the inner wall of the collet body 23. When the retrievable expansion cone is used, the setting barrel 8 of the retrievable expansion cone is adapted to abut against the interior of the collet body 23. Meanwhile, the release lever 7 passes through the collet body 23 to be connected with the lower joint 4. While the lower joint 4 generates a pulling force towards the outside of the well, thrust towards the inside of the well is applied to the collet body 23 by pushing, by the pushing barrel 5, the setting barrel 8 to abut against the interior of the collet body 23. At this time, under the opposite acting forces of the lower joint 4 and the setting barrel 8 to the collet body 23, the end of the setting barrel 8, which is away from the pushing barrel 5, can also provide support for the inner wall of the collet body 23, so that the expansion of the collet body 23 is directed, therefore it prevents the collet body 23 from damage, i.e., preventing the sealing ring 2 and the slip 3 from damage, and ensures the setting safety of the clamping seat. After the clamping seat is set, the setting barrel 8 may be withdrawn from the well with the pushing barrel 5, and recycled.

As a preferred embodiment, the pushing barrel 5 and the setting barrel 8 are of an integrated member. In this embodiment, the pushing barrel 5 and the setting barrel 8 are an integrated member integrally formed, so that it is ensured the integrity of the aforementioned parts that generates thrust to the collet body 23 and the quality of the retrievable expansion cone is improved. With the retrievable expansion cone, there is no need to connect the pushing barrel 5 and the setting barrel 8, so that the mounting of the retrievable expansion cone is simpler and more convenient, and the use convenience of the retrievable expansion cone is improved.

Of course, when the outer wall of the setting barrel 8 can be adapted to the inner wall of the cone of the prior art ball seat, the retrievable expansion cone can enhance the support for an interior of the cone, and thus improve the safety during setting of the ball seat in the prior art.

This embodiment provides a downhole setting system. As shown in FIGS. 12-14, the downhole setting system includes the clamping seat according to Embodiment 2 and the retrievable expansion cone according to Embodiment 1, wherein FIGS. 12 & 13 are a stereoscopic structural diagram and a front view of the setting system according to one or more embodiments, respectively; and FIG. 14 is a sectional view at D-D in FIG. 13.

The first end of the release lever 7 of the retrievable expansion cone is connected with the first end of the adapter joint 6 of the retrievable expansion cone, and the second end of the release lever 7 is detachably connected with the lower joint 4. Specifically, the end of the release lever 7 is connected with the lower joint 4 of the clamping seat through a pin. When an acting force between the release lever 7 and the lower joint 4 is too large, the pin will be sheared off, which separates the retrievable expansion cone from the clamping seat. In addition, an outer wall of the second end, close to the clamping seat, of the setting barrel 8 of the retrievable expansion cone is adapted to abut against the inner wall of the collet body 23. Specifically, the outer wall of the second end of the setting barrel 8, which is conical, is adapted to abut against the inner wall of the collet body 23, so that the setting barrel 8 can support and limit the interior of the collet body 23.

The setting system according to this embodiment, a connecting lever is connected to, the lower joint 4 to provide an axial force towards the outside of the well for the collet body 23. At the same time, the outer wall of the setting barrel 8 of the retrievable expansion cone is adapted to abut against the inner wall of the collet body 23 of the clamping seat, and the setting barrel 8 provides the axial force towards the inside of the well for the collet body 23. Therefore, the collet body 23 expands due to axial squeezing. The outer wall of the setting barrel 8 provides support for the inner wall of the collet body 23 and directs the expansion of the collet body 23, therefore ensures the sealing and anchoring functions of the collet body 23. Hence, the clamping seat can complete the setting operation. After the setting is completed, the entire retrievable expansion cone can be recovered at the outside of the well. Compared with the prior art, the downhole clamping seat has no cone structure of the ball seat, and thus, the entire structure is shorter. This facilitates downhole dissolution of the clamping seat or downhole drilling, and removal of the same from the well when a full-bore casing is formed later. Therefore, operation time can be shortened. Furthermore, there are less residues in the well after the full-bore casing is formed, which prevents the casing from being blocked. In the case where the downhole casing has certain inner diameter, the clamping seat has a thinner wall and a larger internal channel since the cone structure is removed. As a result, the flowing and flowback of the well fluid are facilitated and the flowback efficiency of a fracturing fluid or impurities in the well is high.

This embodiment provides a setting method. As shown in FIGS. 12-14, the downhole setting system according to Embodiment 4 is used in this setting method. The setting method includes the following steps: In step I, the downhole setting system is fed to a specified setting position in the downhole casing.

In step II, the force towards the outside of the well is applied to the adapter joint 6, and at the same time the force towards the inside of the well is applied to the setting barrel 8 with the pushing barrel 5. That is, while a pulling force towards the outside of the well is generated to the lower joint 4, thrust towards the inside of the well is applied to the collet body 23 by pushing from the pushing barrel 5, the setting barrel 8 to abut against the interior of the collet body 23. In this case, under the opposite acting forces from the lower joint 4 and the setting barrel 8 to the collet body 23, the first end, away from the pushing barrel 5, of the setting barrel 8 can also provide support to the inner wall of the collet body 23, thereby limiting the expansion direction of the collet body 23, preventing the collet body 23 from damage, i.e., preventing the sealing ring 2 and the slip 3 from damage, and ensuring the setting safety of the clamping seat. Meanwhile, the collet body 23 moves along the outer wall of the setting barrel 8 and deforms until the outer wall of the sealing ring 2 of the collet body 23 contacts with the inner wall of the casing, so the slip teeth 32 of the slip 3 of the collet body 23 anchor to the inner wall of the casing while the lower joint 4 is separated from the release lever 7 and disengaged from the collet body 23.

In step III, the retrievable expansion cone is recovered, therefore the setting is completed.

In the setting method according to this embodiment, the clamping seat is set by operating the retrievable expansion cone. The setting barrel 8 of the retrievable expansion cone abuts against the inner wall of the collet body 23, and can provide an axial acting force and a radial support force for the collet body 23 while limiting the expansion deformation of the collet body 23, so the integrated collet 23 is stably set at the specified position of the downhole casing, thereby ensuring that the fracturing ball can plug the collet body 23 safely later.

Figure 15:
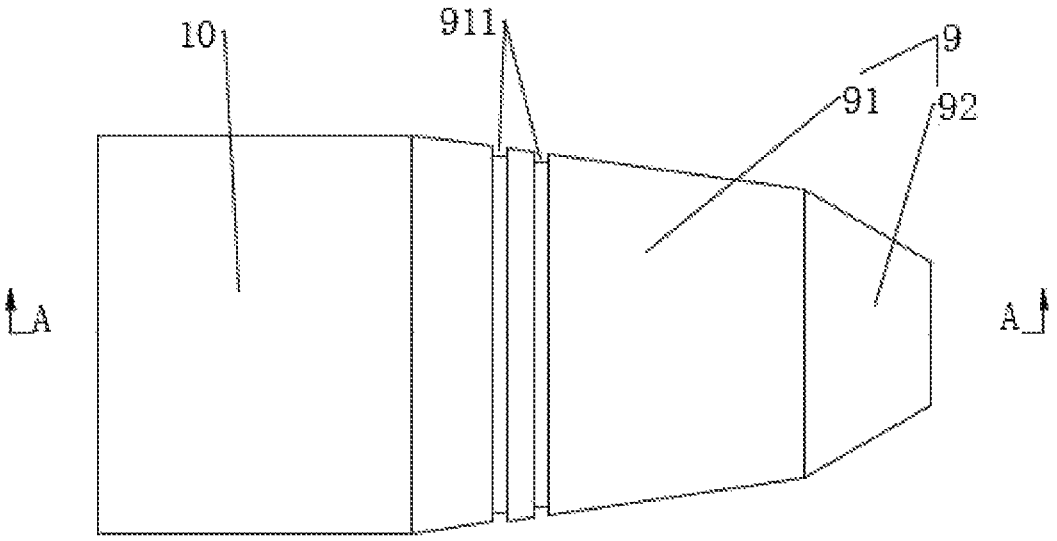
FIG. 15 is a front view of a plugging body according to Embodiment 4.
Figure 16:
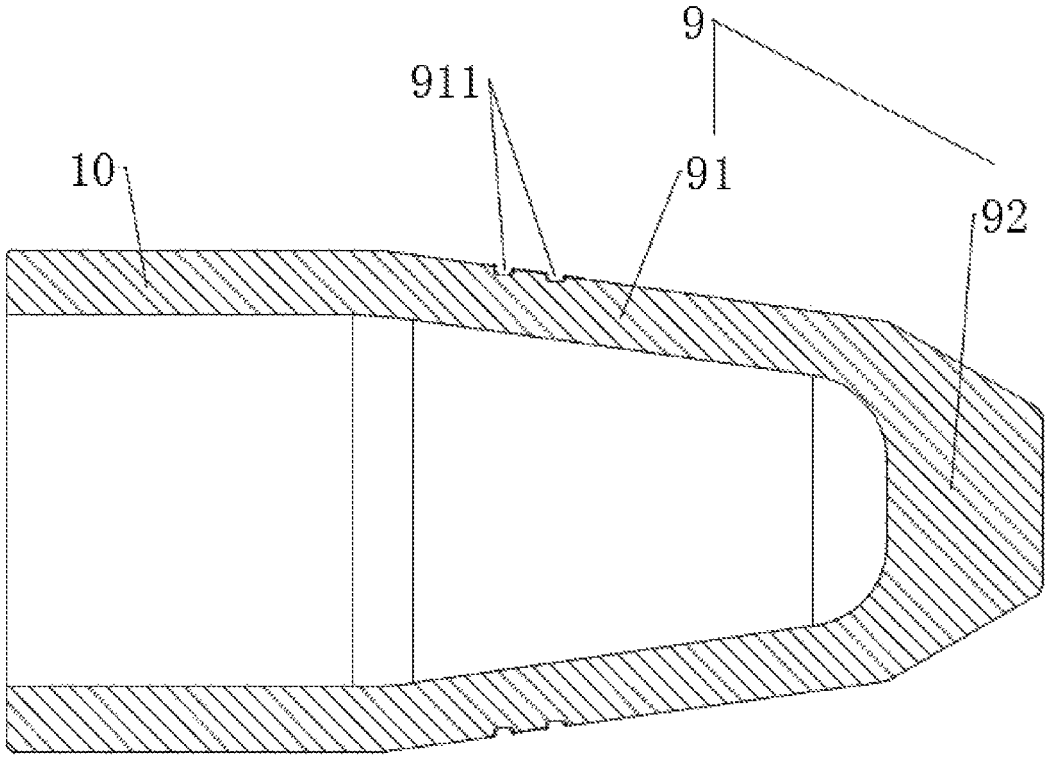
FIG. 16 is a first sectional view at A-A in FIG. 15.
Figure 17:
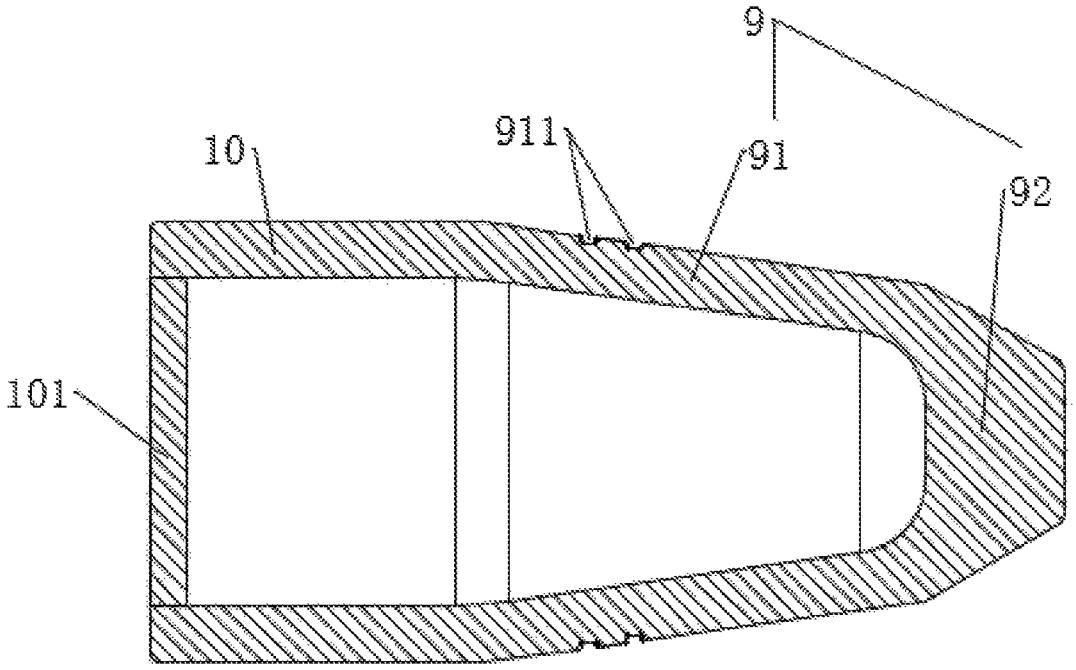
FIG. 17 is a second sectional view at A-A in FIG. 15.

This embodiment provides a plugging body. Referred to FIGS. 15-17, wherein FIG. 15 is a front view of the plugging body according to this embodiment, and FIGS. 16 & 17 are a first and a second sectional view at A-A in FIG. 15, respectively. The plugging body includes a plugging section 9 provided with a support section 91; the support section 91 is a hollow structure with the closed end; the outer wall of the support section 91 is a conical plugging body surface; the closed end is located at a small end of a cone formed by the conical plugging body surface; and the outer wall of the support section 91 matches the inner wall of the ball seat.

The plugging body is configured to fracture the internal channel of the ball seat and may be soluble or insoluble. When the plugging body is soluble, it has to be dissolved when a full-bore casing is formed. When the plugging body is insoluble, it needs to be drilled to form the full-bore casing, so that the plugging body is drilled into scraps and the scraps are removed out of the casing through flowback of the well fluid. With the adoption of the plugging body of the present disclosure, as the support section 91 is of the hollow structure, the formation time of the full-bore casing can be shortened, and the oil well can be put into production punctually. Thus, a production-ready channel is provided for the oil and gas wells earlier. In addition, compared with a prior art fracturing ball, the plugging body can enter the internal channel of the ball seat for plugging; and the outer wall of the support section 91, which is the conical plugging body surface, matches the inner wall of the ball seat, which is also conical, to achieve surface plugging, so that the plugging effect is improved. Moreover, after plugging, the well fluid enters the hollow structure of the plugging body and the plugging body can support the ball seat from the inner wall of the ball seat and plug the internal channel of the ball seat, so that the pressure-bearing capacity of the ball seat in the well and the plugging effect of the plugging body on the ball seat are improved.

This embodiment takes the soluble plugging body as an example. Specifically, with reference to FIGS. 15-17, the plugging body includes a plugging section 9 on right and a straight barrel section 10 on left. The straight barrel section 10 is configured to limit the direction of the plugging body in the process that the plugging body enters the downhole casing and plugs the ball seat to prevent the plugging body from overturn, deviation and the like in the downhole casing, thereby improving the plugging safety of the plugging body and preventing the plugging body from failing to plug the ball seat. In this embodiment, a combined length of the plugging section 9 and the straight barrel section 10 are greater than an inner diameter of the downhole casing that is plugged. For example, when the downhole casing having a diameter of 127 mm is set, the combined length of the plugging section 9 and the straight barrel section 10 on the left is set to 140 mm to ensure that the plugging body does not turn over and deviate in the casing. The plugging section 9 includes the support section 91 and a guide section 92 connected with a right end of the support section 91. The straight barrel section 10 is disposed at a second end, away from the guide section 92, of the plugging section 9. The guide section 92 is of a solid structure, and the support section 91 is of a hollow structure. That is, the support section 91 has an internal chamber, and an internal chamber of the straight barrel section 10 is communicated with the internal chamber of the support section 91. Thus, a storage space for the plugging body to carry a chemical or a sensor is enlarged. The internal chamber of the straight barrel section 10 can be enclosed or not enclosed after being communicated with the internal chamber of the support section 91. If the internal chamber of the straight barrel section 10 is enclosed, as shown in FIG. 17, an end cap 101 is used to block an opening in an left end of the straight barrel section 10, or block an opening in an left end of the support section 91, so that only the internal chamber of the support section 91 is enclosed (not shown in the figures). The enclosed chamber may be configured to store a sensor or a chemical. For example, with the enclosed chamber carrying the chemical into a well, the dissolution of a downhole plugging system is accelerated, or the dissolution time of the plugging body is controlled, when the chemical includes a solid acid chemical such as citric acid, oxalic acid or sulfamic acid. Or, with the enclosed chamber carrying a temperature sensor into the well, the real-time temperatures at a plugging position of the ball seat is collected, so as to predict the dissolution time of the plugging body at its position in the well. When the chamber of the support section 91 is not enclosed after being communicated with the chamber of the straight barrel section 10, as shown in FIG. 16, a contact area between the plugging body and well fluid can be enlarged, and thus, the dissolution rate of the plugging body is increased. Meanwhile, the well fluid enters the hollow structure of the plugging body, and the plugging body can support the ball seat from the inner wall of the ball seat and plug the internal channel of the ball seat, so that the pressure-bearing capacity of the ball seat in the well and the plugging effect of the plugging body on the ball seat are improved.

Figure 19:
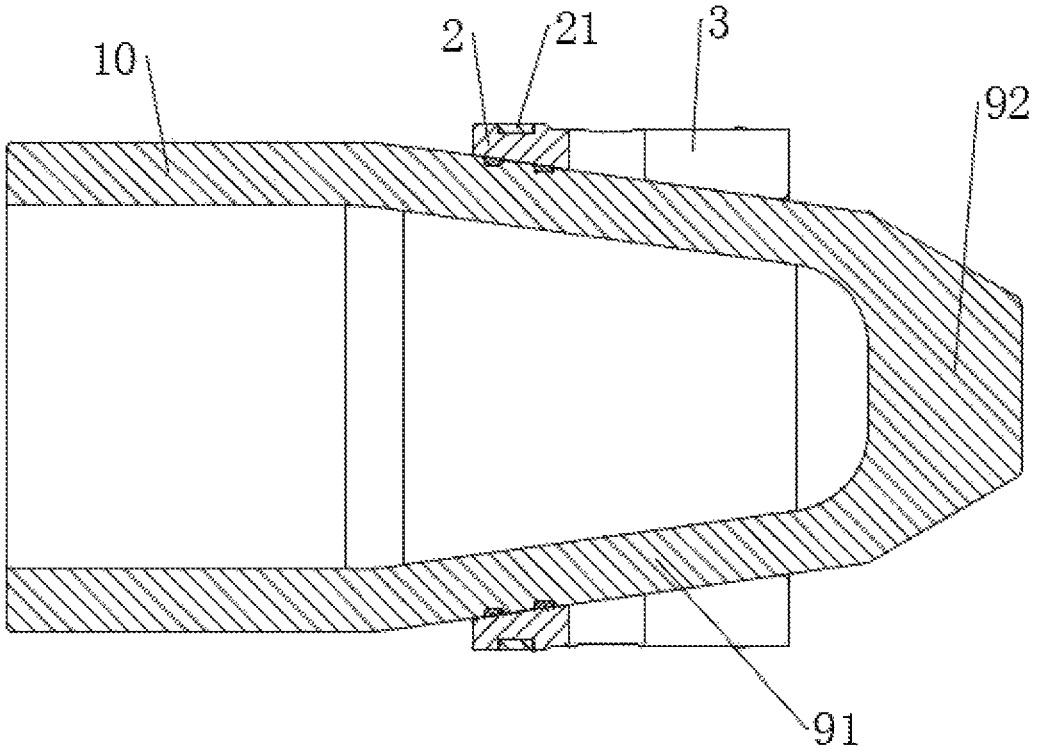
FIG. 19 is a sectional view at B-B in FIG. 18.

The outer wall of the support section 91 being the conical plugging body surface, as shown in FIG. 15, means that outer diameters of the support section 91 gradually decrease from left to right along the radial direction, which helps the outer wall of the support section 91 abutting against the inner wall of the ball seat. As a result, the plugging body can support the ball seat from the inner wall of the ball seat and plug the internal channel of the ball seat, so that the pressure-bearing capacity of the ball seat in the well and the plugging effect of the plugging body on the ball seat are improved. Moreover, at least one circumferential groove 911 is formed in the outer wall of the support section 91, and the groove 911 is adapted to accommodate an O-ring or a rubber gasket ring 21. In this embodiment, the O-ring is taken as an example, two grooves 911 are formed in the outer wall of the support section 91, and one O-ring is disposed in each groove 911, as shown in FIG. 19. The O-ring is configured for assisting in sealing. An outer wall of the guide section 92 is a conical plugging body surface. A plugging section of the support section 91 is connected with the guide section 92, and a slope of the outer wall of the guide section 92 in its axial direction is greater than that of the outer wall of the support section 91. The guide section 92 is of the solid structure and can position the center of gravity of the plugging body at a center axis of the plugging body, so that the center of gravity of the plugging body is gathered at the guide section 92 of the plugging body. The conical guide section 92 can better resist medium resistance, and facilitates guiding of the plugging body and insertion of the plugging body into the ball seat. As a preferred embodiment, the straight barrel section 10 and the plugging section 9 is an integrated member, that is, the plugging body is an integrated member. In this embodiment, the plugging body is an integrally formed member. As being the integrally formed member, the plugging body has better integrity and higher strength, thereby improving the pressure-bearing capability of the plugging body. As such, it is convenient for the plugging body to plug the ball seat in the downhole casing, thereby improving the plugging quality of the downhole plugging system.

This embodiment provides the downhole plugging system. With reference to FIGS. 3-6 and 15-19, the downhole plugging system includes the clamping seat and the plugging body according to Embodiment 6.

The clamping seat includes the integrated collet. The integrated collet can form the seal with the inner wall of the downhole casing, and is anchored to the inner wall of the downhole casing and provided with the channel along its axial direction. The shape and size of the inner wall of the integrated collet are adapted to those of the outer wall of the support section 91 respectively.

The integrated collet has both the sealing and anchoring functions, can form the seal with the inner wall of the downhole casing and at the same time anchor itself to the inner wall of the downhole casing. The inner wall of the integrated collet being the conical surface means that the inner diameter of the integrated collet gradually decreases from the first end, away from the lower joint 4, of the integrated collet to the second end thereof, which is convenient for the plugging section 9 to support and plug the integrated collet from the interior of the integrated collet. The integrated collet is the plastically deformable member which can retain its shape after being subjected to expansion deformation, instead of returning to its original shape; the inner wall of the plastically deformable member is the conical surface; and the slip teeth 32 are disposed on the outer wall of the plastically deformable member. The two ends of the plastically deformable member are squeezed via the setting tool cooperating with the lower joint 4 of the clamping seat, and the setting tool has the conical member capable of extending into the plastically deformable member for supporting, so that the plastically deformable member can be restricted to undergo outward expansion deformation radially to achieve sealing. At the same time, the slip teeth 32 anchor the integrated collet to the inner wall of the casing to achieve setting. The retrievable expansion cone as shown in FIGS. 10 and 11 may be used as the setting tool.

In this embodiment, with reference to FIGS. 3-6, the integrated collet includes the sealing ring 2 and the slip 3. The slip 3 includes the slip bowl 31 and the plurality of slip teeth 32. The slip teeth 32 are disposed in the slip tooth 32 grooves in the outer wall of the slip bowl 31. Both the slip bowl 31 and the sealing ring 2 are plastically deformable members and are integrated into one piece to form the integrated member. The plastically deformable member can retain its shape after being subjected to expansion deformation, instead of returning to its original shape, thereby ensuring that the integrated collet can maintain a stable seal with the inner wall of the casing. With two end surfaces of the integrated collet squeezed by opposite acting forces respectively, both the sealing ring 2 and the slip bowl 31 are subjected to the expansion deformation due to squeezing until the outer wall of the sealing ring 2 can be tightly attached to the inner wall of the downhole casing to achieve the sealing function of the integrated collet. At the same, the slip teeth 32 of the slip 3 anchor the integrated collet to the inner wall of the downhole casing to complete the setting. As a preferred embodiment, the sealing ring 2 is provided with at least one lap of the O-ring or rubber gasket ring. Both the O-ring and the rubber gasket ring are configured for assisting in sealing. In this embodiment, the O-ring is taken as an example, in another embodiment the rubber gasket ring is taken for assisting in sealing.

The sealing ring 2, the slip bowl 31 and the plugging body all may be made of the soluble material, or the insoluble material or the insoluble composite material. In the process that the full-bore casing is formed after the clamping seat is set and then plugged by the plugging body: when the clamping seat and the plugging body are made of the soluble material, since the clamping seat has fewer structural members compared with the ball seat in the prior art, the dissolution time of the clamping seat is shorter and there are fewer residues. When the clamping seat is made of the insoluble material or the insoluble composite material, it needs to remove the clamping seat by drilling. Since the clamping seat has fewer structural members compared with the ball seat in the prior art, the drilling time of the clamping seat and the time spent in pulling or discharging the drilled clamping seat out of the well are shorter, and the clamping seat can be conveniently removed from the well.

Specifically, in this embodiment, the soluble clamping seat and the soluble plugging body are taken as an example. In this embodiment, both the sealing ring 2 and the slip bowl 31 are members with an elongation between 14% and 40%, including metal members, non-metal members or composite members, which can meet the plastic deformation of the sealing ring 2 and the slip bowl 31 and ensure that the sealing ring 2 does not return to its original shape after being deformed. Further, it can ensure that the slip 3 can anchor the sealing ring 2 at a specified position. For example, these members may be made of the high-elongation metal. In this embodiment, both the slip bowl 31 and the sealing ring 2 are the plastically deformable magnesium alloy members or other soluble metals, the elongation of which can reach 14%-40%. The soluble metal refers to such a metal that can be dissolved in a liquid having corresponding salinity.

Figure 18:
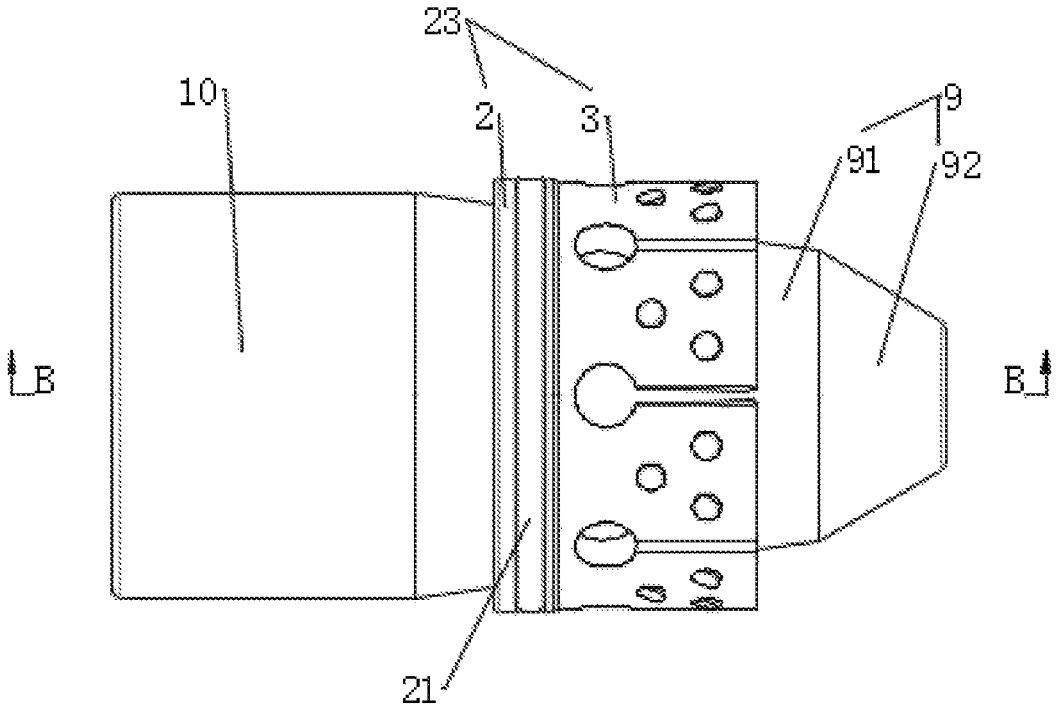
FIG. 18 is a diagram showing cooperation between the plugging body and the integrated collet after plugging according to Embodiment 5.

Specifically, as shown in FIGS. 3-6 and 18-19, wherein FIG. 18 is a diagram showing cooperation between the plugging body and the integrated collet after plugging according to this embodiment 5, and FIG. 19 is a sectional view at B-B in FIG. 18, the slip bowl 31 is provided with eight toothed plates 311 at the right end. Three slip tooth grooves are formed in each toothed plate 311. All the slip tooth grooves in each toothed plate 311 are axially disposed along the slip bowl 31 and arranged in the triangular pattern. One slip tooth 32 is disposed in each slip tooth groove. The slip tooth 32 is of a cylindrical structure, and the included angle between an outer end surface of the slip tooth 32 and the axial line of the slip bowl 31 is 10°-60°. The outer end surface of the slip tooth 32 faces away from the end of the slip bowl 31, at which the tooth plate 311 is disposed. The outer end surface refers to the surface, facing the groove bottom surface of the slip tooth groove, on the slip tooth 32. This surface forms the included angle with the axial line of the slip bowl 31 to form the inclined surface. As such, the contact area between the slip tooth 32 and the casing is reduced, and the capability of the slip tooth 32 to squeeze into the casing is increased, so that the soluble integrated slip 3 has a better anchoring capability. Of course, the number of the slip teeth 32 may vary according to the stress and design requirements. The slip tooth grooves are uniformly formed in the toothed plates 311, namely, the slip teeth 32 are uniformly disposed on the toothed plates 311. As such, when the toothed plates 311 are opened under force, the slip teeth 32 can more effectively anchor to the casing, and thus the slip 3 has a better anchoring effect.

The gap 33 exists between two adjacent toothed plates 311 and is disposed along the axial direction of the slip bowl 31. Specifically, the gap 33 includes the gap bottom 331 and the gap neck 332. The gap bottom 331 is the stress hole which is an oblong hole (as shown in FIG. 4C), a regularly polygonal hole (as shown in FIG. 4B), an elliptical hole has shown in FIG. 4D) or a circular hole (as shown in FIG. 4A). In this embodiment, an example in which the stress hole is the circular hole and the gap neck 332 is the strip-shaped groove is taken for illustration. The gap neck 332 has its width less than that of the gap bottom 331. Specifically, the gap neck 332 has its width of 3 mm to 5 mm, and the gap bottom 331 has its width which is 3-5 times the width of the gap neck 332. In addition, the integrated collet cooperates with the plugging body to achieve the plugging function of the downhole plugging system, as shown in FIGS. 18 and 19. The support section 91 of the plugging body is of the hollow structure, so that the formation time of the full-bore casing can be shortened, the oil well can be put into production punctually, and a production-ready channel is provided for the oil and gas wells earlier. In addition, compared with the fracturing ball in the prior art, the plugging body can enter the internal channel of the integrated collet for plugging to achieve surface plugging, and thus, the plugging effect is better. Moreover, the plugging body can support the integrated collet from the inner wall of the integrated collet and plug the internal channel of the integrated collet, so that the pressure-bearing capacity of the integrated collet in the well and the plugging effect of the plugging body on the integrated collet are improved.

Compared with the existing downhole plugging, the collet structure has less members, that is, the plugging system has fewer structural parts and thus can be processed conveniently. Moreover, as the plugging system has fewer structural parts, during plugging, it is more convenient to operate the plugging system to plug the casing, and relatively higher safety and reliability are achieved. After the completion of plugging, fewer structural parts are left in the downhole casing, facilitating the formation of the full-bore casing and providing a production-ready channel for oil and gas wells earlier. The material of the collet is not limited. For example, when a soluble collet is used, it is convenient to dissolve the plugging system and hence the dissolution time of the downhole plugging system can be shortened. When an insoluble collet is used, it is convenient to remove the drilled plugging system from the well. Thus, the oil well can be put into production punctually, and the construction cost is reduced. Furthermore, the reduction in residues in the well prevents the casing from being blocked. In the case where the downhole casing has certain inner diameter, the collet has a thinner wall and a larger internal channel since the cone structure is removed. As a result, the flowing and flowback of the well fluid are facilitated and the flowback efficiency of a fracturing fluid or impurities in the well is high. Moreover, the plugging section of the plugging body 9 can be thickened, thereby improving the supporting capability of the plugging body for the integrated collet and the plugging safety of the plugging system.

This embodiment provides a plugging method. With reference to FIGS. 7-11 and 15-19, the downhole plugging system according to Embodiment 7 is used in this plugging method. The plugging method includes a setting step and a plugging step.

Specifically, the clamping seat is assembled firstly and the assembled clamping seat is as shown in FIG. 7. As the clamping seat has fewer parts, the assembly time of the clamping seat and thus the construction time can be shortened.

Then the setting step is performed. The setting step includes setting the clamping seat of the downhole plugging system by a retrievable expansion cone. The retrievable expansion cone includes the pushing barrel 5 having its first end connected with the setting barrel 8; the outer wall of first end of the setting barrel 8 away from the pushing barrel 5 is adapted to abut against the inner wall of the integrated collet; the adapter joint 6 and the release lever 7 are disposed axially in the pushing barrel 5; and a first end of the release lever 7 is connected with a first end of the adapter joint 6, and a second end of the release lever 7 is connected with the lower joint 4 of the clamping seat.

Specifically, the following step is performed firstly: the retrievable expansion cone is assembled firstly and the assembled retrievable expansion cone is as shown in FIG. 11.

Then the following steps of the setting step are performed.

In step I, the second end of the release lever 7 passes through the integrated collet and then detachably connects to the lower joint 4, and the setting barrel 8 abuts against the inner wall of the integrated collet.

In step II, the retrievable expansion cone and the clamping seat are fed to the specified setting position in the downhole casing for preparing for setting the clamping seat.

In step III, the force towards the outside of the well is applied to the adapter joint 6, and at the same time, the force towards the inside of the well is applied to the setting barrel 8 with the pushing barrel 5. That is, while the pulling force towards the outside of the well is generated to the lower joint 4, thrust towards the inside of the well is applied to the collet body 23 by pushing from the pushing barrel 5, the setting barrel 8 to abut against the interior of the collet body 23. At this time, under the opposite acting forces of the lower joint 4 and the setting barrel 8 to the collet body, the end of the setting barrel 8 that is away from the pushing barrel 5, can also provide support for the inner wall of the collet body, therefore limits the expansion direction of the collet body, prevents the collet body from damage, i.e., prevents the sealing ring 2 and the slip 3 from damage, and ensures the setting safety of the clamping seat. At this time, the collet body moves along the outer wall of the setting barrel 8 and deforms until the outer wall of the sealing ring 2 of the collet body contacts to the inner wall of the casing, so that the slip teeth 32 of the slip 3 of the collet body anchor to the inner wall of the casing while the lower joint 4 is separated from the release lever 7 and disengaged from the collet body 23.

In step IV, the retrievable expansion cone is recovered, wherein the setting barrel 8 can withdraw from the well with the pushing barrel 5 and can be recycled. At this time, the downhole casing only has the integrated collet set on the inner wall of the casing and the lower joint 4 dropped to the well bottom, and the setting is completed.

After the clamping seat is set, the plugging step is performed, wherein the plugging section 9 of the plugging body is inserted into the integrated collet that is already set, so that the outer wall of the plugging section 9 abuts against the inner wall of the integrated collet until the plugging section 9 plugs the internal channel of the integrated collet, thereby completing the downhole plugging.

In this embodiment, FIGS. 18 and 19 show a state after the plugging section 9 plugs the integrated collet. In this embodiment, the plugging body includes the straight barrel section 10 and the plugging section 9. The straight barrel section 10 has a radial outer diameter greater than the internal dimension of the integrated collet. The plugging section 9 includes the support section 91 and the guide section 92. The guide section 92 of the plugging body is disposed first, and then the plugging body is fed into the downhole casing. As such, the center of gravity of the plugging body is on a center axis thereof and located on the guide section 92. Both the guide section 92 and a right end, close to the guide section 92, of the support section 91 of the plugging body can stably enter the integrated collet, and the outer wall of the support section 91 of the plugging section 9 is closely attached to the inner wall of the integrated collet to achieve plugging.

When the plugging method according to this embodiment is used for plugging the downhole casing, the clamping seat is set by operating the retrievable expansion cone. The setting barrel 8 of the retrievable expansion cone can support the integrated collet from the interior of the integrated collet and limit the expansion deformation of the integrated collet, so that the integrated collet is subjected to outward expansion deformation radially. As such, the integrated collet can be stably set at a specified position of the downhole casing, thereby ensuring that the plugging body can plug the integrated collet safely later. By operating the plugging body to enter the set integrated collet for plugging, the integrated collet is assisted in bearing the pressure. As such, the well layer is stably plugged and the plugging construction is safer, thereby ensuring that fracturing reformation is performed safely.

Figure 20:
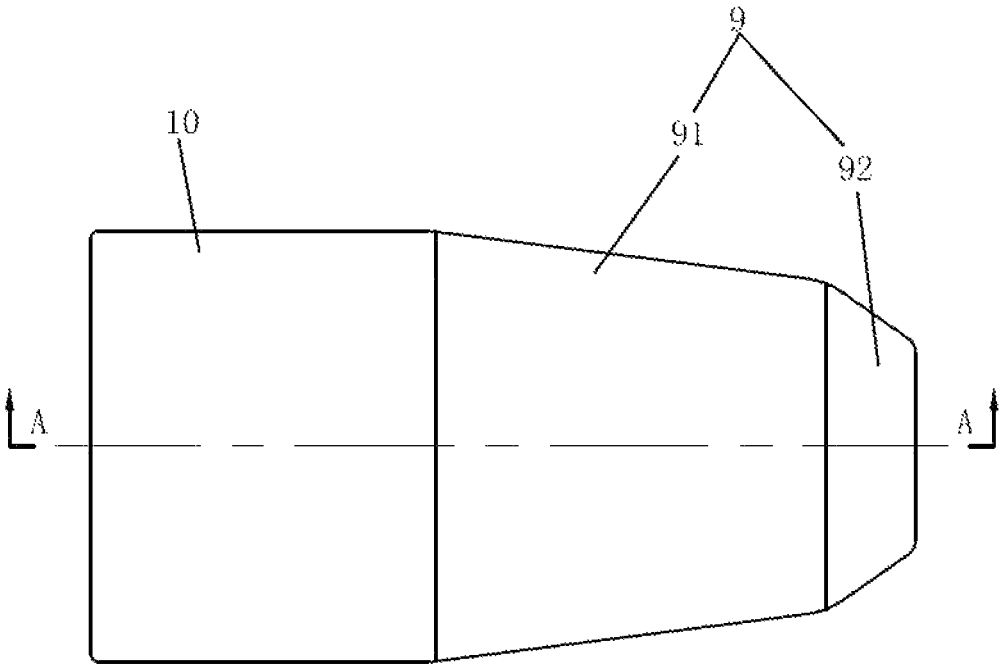
FIG. 20 is a front view of a plugging body according to Embodiment 7.
Figure 21:
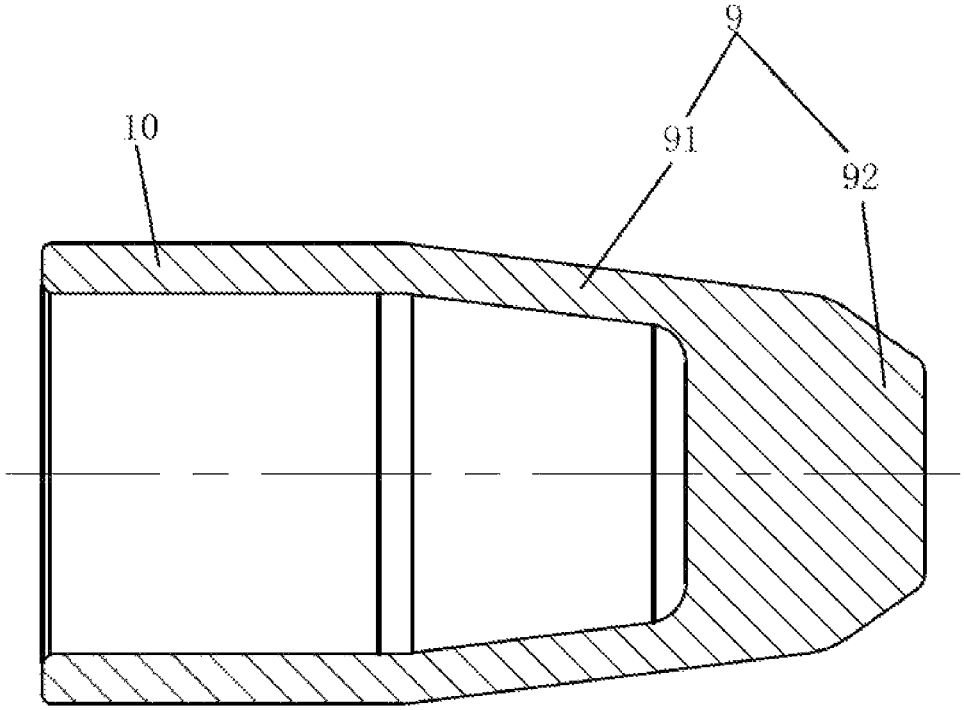
FIG. 21 is a first sectional view at A-A in FIG. 20.

This embodiment provides another plugging body. FIG. 20 is a front view of the plugging body according to Embodiment 7, and FIG. 21 is a first sectional view at A-A in FIG. 20. Referred to FIGS. 20-21 the plugging body includes a plugging section 9 on right and a straight barrel section 10 on left, the plugging section 9 includes the support section 91 and a guide section 92 connected with a right end of the support section 91. The difference of plugging body between the embodiment 6 and the embodiment 6 is that no circumferential groove is formed in the outer wall of the support section 91, the outer wall of the support section 91 matches the inner wall of the ball seat to achieve directly surface plugging.

The collet body has the sealing function and the anchoring function, is configured to set in the casing and forms the seal with the inner wall of the downhole casing and at the same time anchors itself to the inner wall of the downhole casing. The inner wall of the collet body being the conical shape means that its inner diameters gradually decrease from the first end that is away from the lower joint of the collet body, to the second end thereof. For example, the collet body includes the plastically deformable member which is able to retain its shape after expansion and deformation under force, instead of returning to its original shape. The inner wall of the plastically deformable member is of conical shape, and slip teeth are disposed on the outer wall of the plastically deformable member. By squeezing two ends of the plastically deformable member with the setting tool, the plastically deformable member expands and deforms outwardly and radially to achieve sealing, and at the same time the slip teeth anchor the collet body to the inner wall of the casing to achieve setting. The integrated collet of the present disclosure can have both the sealing and anchoring functions and is configured to set in the casing. Compared with the prior art ball seat which achieves the sealing and anchoring via two separate parts respectively, i.e., the sealing ring and the slip, the integrated collet has the simpler structure, is convenient for the setting operation of the ball seat, and thus has the extremely high practical value and improved cost-efficiency.

Preferably, the collet body includes the sealing ring and the slip, wherein the slip includes the slip bowl and the plurality of slip teeth; both the slip bowl and the sealing ring are plastically deformable members, and, both are integrated into one part; the sealing ring is arranged at the first end of the slip bowl, and the plurality of toothed plates are arranged at the second end of the slip bowl; and the gap is provided between two adjacent toothed plates and is disposed along the axial direction of the slip bowl.

The slip teeth are provided in slip tooth grooves in the outer wall of the slip bowl.

The collet body includes the sealing ring and the slip, and has the sealing function and the anchoring function of the prior art ball seat. Since the slip bowl and the sealing ring are integrated as one part and is the plastically deformable member, as two end surfaces of the collet body being squeezed by opposite acting forces respectively, both the sealing ring and the slip bowl are subjected to expansion deformation due to squeezing until the outer wall of the sealing ring is tightly attached to the inner wall of the downhole casing to achieve the sealing function of the collet body. At the same time, the slip teeth of the slip anchor the collet body to the inner wall of the downhole casing to complete the setting. The shape and size of the gap are determined according to actual design situations as long as the toothed plates can be opened to facilitate anchoring of the slip teeth to the inner wall of the downhole casing, i.e., achieving the anchoring function of the integrated collet. Meanwhile the bearing capability of the integrated collet should be met to prevent the integrated collet from damage and ensure the sealing function of the integrated collet. When the collet body is subjected to the squeezing forces from two ends, the toothed plates at the second end of the slip bowl that is away from the sealing ring are opened under said forces, that is, the toothed plates at the second end of the slip bowl, with which the lower joint abuts, are opened under the forces, so that the slip teeth on the outer wall of the slip bowl are more effectively anchored to the inner wall of the downhole casing; and meanwhile, the end surface of the first end of the slip bowl can transfer the axial force evenly to the sealing ring to ensure no damage to the sealing ring.

Preferably, each of the gap includes the gap bottom and the gap neck, wherein the gap bottom is the stress hole; the gap neck is the strip-shaped groove; the stress hole communicates with the strip-shaped groove; the opening of the strip-shaped groove is formed in its first end away from the sealing ring; and the gap neck has the width smaller than that of the gap bottom.

The gap between the two adjacent toothed plates includes the gap bottom close to the sealing ring and the gap neck close the lower joint. The gap bottom is the stress hole for preventing the slip bowl from damage due to stress concentration. The gap neck is the strip-shaped groove with the opening formed in the first end away from the sealing ring, i.e., the end close to the lower joint, so that when the gap neck is subjected to the abutting force of the lower joint, it is convenient for the toothed plates to open to ensure the anchoring operation of the slip, i.e., ensure the anchoring operation of the collet.

Preferably, all the stress holes are uniformly formed along the circumferential direction of the slip bowl, so that all the stress holes can evenly bear the stress along the circumferential direction of the slip bowl to prevent the slip bowl from damage due to stress concentration.

Preferably, the stress hole is the oblong hole, the polygonal hole, the elliptical hole or the circular hole. The adoption of the regular shape facilitates manufacturing process of the stress hole. Of course, the exact size of the aforementioned shape is determined according to actual designs. It is also possible to use other shapes and structures which can reduce stress concentrated on the slip bowl. When the oblong hole is used, the long side of the oblong hole communicates with the trip-shaped groove via its opening in one of its ends. That is, the gap is equivalent to the T-shaped groove structure, which facilitates the opening of the toothed plates and further meets the anchoring capability of the integrated collet. In addition, the width of the oblong hole along the axial direction of the integrated collet is adjusted according to actual stress conditions to meet the whole stress condition of the integrated collet, thereby preventing the integrated collet from damage and further meeting the sealing capability and the anchoring capability of the integrated collet.

Preferably, when the stress hole is the oblong hole, the oblong hole in its length direction is perpendicular to the axial direction of the collet body.

Since the stress hole in the slip is the oblong hole and the oblong hole is set relatively long to release the stress in the circumferential direction of the slip, stress of the slip at the connection position between the slip and the sealing ring will be released more sufficiently. Thus, the sealing effect of the sealing ring would not be affected and the slip may be more efficiently expended by fracturing without generating stress, thereby improving the reliability of the slip. Moreover, as the hole is strip-shaped and will not occupy the significant surface area of the entire slip, the strength of the slip is basically not affected.

Preferably, when the stress hole is the polygonal hole, the polygonal hole forms the elongated hole in the circumferential direction of the collet body and is perpendicular to the axial direction of the collet body, and two long sides of the elongated hole are parallel to each other.

Since the stress hole is the polygonal hole and forms the elongated hole in the circumferential direction which is set relatively long to release the stress in the circumferential direction of the slip, the stress of the slip at the connection position between the slip and the sealing ring will be released more sufficiently. Thus, the sealing effect of the sealing ring would not be affected and the slip may be more efficiently expended by fracturing without generating stress, thereby improving the reliability of the slip. Moreover, as the hole is strip-shaped and will not occupy the significant surface area of the entire slip, the strength of the slip is basically not affected. Furthermore, after the setting is completed, the plugging function is realized by feeding the plugging body into the inner surface of the collet. After the casing is plugged and the first end of the slip is stressed, the two long sides of the elongated hole are parallel and very close to each other and thus are squeezed together. As such, the slip has the good supporting effect on the sealing ring, and the sealing ring will have excellent sealing reliability.

The downhole plugging system includes the integrated collet and the plugging body.

The integrated collet includes the collet body, wherein the collet body can form the seal with the inner wall of the downhole casing and is anchored thereto; the internal channel is formed inside the collet body along its axial direction; and the inner wall of the internal channel of the collet body is the comical collet surface, wherein the internal channel's cross-section along the axial directions is of conical shape.

The plugging body includes the plugging section provided with the support section thereon; the support section is of the hollow structure with the closed end; the outer wall of the support section is the conical plugging body surface; the closed end is located at the first end, with relatively smaller diameter, of the cone formed by the conical plugging body surface; and the conical collet surface and the conical plugging body surface matches each other and form the seal.

The integrated collet of the present disclosure can have both the sealing function and the anchoring function and is configured to set in the casing. Compared with prior art ball seat which achieves the sealing and anchoring depending on two separate parts respectively, i.e., the prior art sealing ring and the prior art slip, the integrated collet has the simpler structure, is convenient for the setting operation of the ball seat, and thus has the extremely high practical value and higher cost performance. Since the conical collet surface and the conical plugging body surface matches each other and form the seal, surface plugging is achieved and the plugging effect is improved. Furthermore, the plugging section includes the support section which is of the hollow structure. The plugging body may consist of the soluble member and its hollow structure is communicated with outside environment. Such the structure can increase the contact surface of the plugging body with the well fluid in the casing, and thus improves dissolvability of the plugging body. At this time, only one end of the support section is communicated with the outside, and the closed end of the support section needs to be in the closed state for fracturing, the soluble member may be used as the plugging body and the hollow structure is the closed space. Such the hollow structure may be configured to accommodate the sensor or the chemical. For example, when the hollow structure carries the chemical into the well, the dissolution of the plugging body can be accelerated; or the dissolution time of the plugging body is controlled through the chemical carried, thus facilitates full-bore casing. The hollow structure may also carry the temperature sensor into the well for collecting real-time temperatures at the plugging position of the ball seat so as to predict the dissolution time of the plugging body at its position in the well. The plugging body may also consist of the insoluble member. Such the structure can reduce the drilling volume of the plugging body and drilling difficulty of the plugging body and further shorten drilling time of the plugging body and removal time of the drilled plugging body. The use of the plugging body of the present disclosure can shorten the formation time of the full-bore casing and meanwhile better prepare the well into production and provide the production-ready channel for the oil and gas wells. In addition, compared with the prior art fracturing ball, the plugging body can enter the internal channel of the ball seat for plugging to achieve surface plugging and thus has the better plugging effect. Moreover, the plugging body can support the ball seat from the inner wall of the ball seat and plug the internal channel of the ball seat, thereby improving the pressure-bearing capability of the ball seat in the well and the plugging effect of the plugging body on the ball seat.

Preferably, the downhole plugging system includes the described hereinabove.

Preferably, the plugging section further includes the guide section connected with the closed end of the support section; the outer wall of the guide section is the conical guide section surface; and when comparing slopes towards the same direction at the axial direction of the support section, the guide section's slop is greater than that of the outer wall of the support section.

The guide section is connected with the first end of the plugging body, and has the guide effect. The guide section is configured to help to guide the plugging body, so that the support section having the hollow structure can enter the ball seat more easily for plugging. Alternatively, the guide section may be of the solid structure, has the volume smaller than that of the support section, and can position the center of gravity of the plugging body at the guide section of the plugging body. Because its outer wall is the conical surface, the guide section can better resist the medium resistance, and facilitate guiding of the plugging body and insertion of the plugging body into the ball seat, so that the plugging body can better plug the ball seat.

Preferably, the straight barrel section is disposed at the end of the support section away from the closed end; the straight barrel section and the plugging section are integrated into one member; and the internal chamber of the straight barrel section is communicated with the internal chamber of the support section.

The straight barrel section is configured to guide the plugging body in the process when the plugging body enters the casing and plugs the ball seat, and to prevent the plugging body from overturn, deviation and alike in the downhole casing, therefore improves plugging safety of the plugging body and prevents the plugging body from failing to plug the ball seat. In addition, since the internal chamber of the straight barrel section is communicated with the internal chamber of the support section, the storage space for the plugging body to carry the chemical or the sensor is enlarged. The straight barrel section and the plugging section are of the integrated member, that is, the plugging body is the integrated member, so that the plugging body has better integrity, and the pressure-bearing capability of the plugging body can be improved. This facilitates plugging the ball seat in the downhole casing by the plugging body and improves the plugging quality of plugging the ball seat by the plugging body.

Preferably, at least one circumferential groove is formed in the outer wall of the support section, and the groove is adapted to accommodate the O-ring or the rubber gasket ring and is located at the sealing ring.

By forming at least one circumferential groove in the outer wall of the support section, the rubber gasket ring or O-ring adapted to the groove can be mounted in the groove and thus when the plugging body plugs the internal channel of the ball seat, the rubber gasket ring or O-ring can assist in sealing the ball seat, thereby enhancing the plugging effect of the plugging body on the ball seat. The groove is located at the sealing ring, so that the sealing effect at the sealing ring is optimized.

A plugging method includes the following plugging steps:

Inserting the plugging section of the plugging body into the integrated collet that is already set, abutting the outer wall of the plugging section against the inner wall of the integrated collet, and plugging the internal channel of the integrated collet by the plugging section, thereby completing the downhole plugging.

When the plugging method is adopted to plug the downhole casing, by operating the plugging body to enter the integrated collet for plugging, the integrated collet is assisted in bearing the pressure. As such, the well layer is stably plugged and the plugging construction is safer, thereby ensuring that fracturing reformation is performed safely.

Preferably, the plugging method further includes the setting step prior to the plugging step.

The setting step contains setting the clamping seat of the downhole plugging system by the retrievable expansion cone. The retrievable expansion cone includes the pushing barrel having its first end connected with the setting barrel; the outer wall of the first end, that is away from the pushing barrel, of the setting barrel is adapted to abut against the inner wall of the integrated collet; the adapter joint and the release lever are disposed axially in the pushing barrel; and the first end of the release lever is connected with the first end of the adapter joint, and the second end of the release lever is connected with the lower joint of the clamping seat.

The setting step includes the following steps:

step I: enabling the second end of the release lever to pass through the integrated collet to be detachably connected with the lower joint, and enabling the setting barrel to abut against the inner wall of the integrated collet;

step II: feeding the retrievable expansion cone and the clamping seat to the specified setting position in the casing;

step III: applying the first acting force towards the outside of the well to the adapter joint, and at the same time applying the second acting force towards the inside of the well to the setting barrel with the pushing barrel, so that the integrated collet moves along the outer wall of the setting barrel and deforms until its outer wall contacts with the inner wall of the casing, and the integrated collet is anchoring to the inner wall of the casing while the lower joint is separated from the release lever and disengaged from the integrated collet; and Step IV: the retrievable expansion cone detaches from the integrated collet, thereby completing setting.

When the plugging method is adopted to plug the downhole casing, the clamping seat is set by operating the retrievable expansion cone. The setting barrel of the retrievable expansion cone can support the integrated collet from the interior of the integrated collet and limit the expansion deformation of the integrated collet, so that the integrated collet is subjected to outward expansion deformation radially. As such, the integrated collet can be stably set at the specified position of the downhole casing, thereby ensuring that the plugging body can plug the integrated collet safely later.

In summary, by adopting the above technical solutions, the present disclosure has the benefits as follows.

1. The integrated collet of the present disclosure can have the sealing function and the anchoring function and is configured to set in the casing. Compared with the existing ball seat which achieves the sealing and anchoring depending on two separate parts respectively, i.e., the sealing ring and the slip, the integrated collet has the simpler structure, is convenient for the setting operation of the ball seat since the sealing ring and the slip adopt the integrated structure, and thus has the extremely high practical value and lower cost performance. Both the sealing ring and the slip bowl of the slip are plastically deformable members, are the integrated member, and thus can synchronously undergo expansion deformation without returning to their original shapes. Further, the sealing function and the anchoring function of the clamping seat can be achieved and it is convenient to set the clamping seat. In addition, as the sealing ring and the slip are integrally formed, the clamping seat has the simpler structure and can be processed more conveniently.

2. For the downhole plugging system of the present disclosure, compared with the ball seat in the prior art which has the cone and the lower joint, the clamping seat of the present disclosure only has the lower joint, and can still be set on the inner wall of the casing with the integrated collet having the anchoring function and the sealing function. Meanwhile, the integrated collet can cooperate with the plugging body to achieve the plugging function of the downhole plugging system. Moreover, the clamping seat has fewer structural parts, that is, the plugging system has fewer structural parts and thus can be processed conveniently. As the plugging system has fewer structural parts, during plugging, it is more convenient to operate the plugging system to plug the casing, and relatively higher safety and reliability are achieved. After the completion of plugging, fewer structural parts are left in the downhole casing, so that the full-bore casing is facilitated, thereby providing the production-ready channel for oil and gas wells earlier. The material of the clamping seat is not limited. For example, when the soluble clamping seat is used, it is convenient to dissolve the plugging system and hence the dissolution time of the downhole plugging system can be shortened. When the insoluble clamping seat is used, it is convenient to remove the drilled plugging system from the well. Thus, the oil well can be put into production punctually and the construction cost is reduced. Furthermore, the reduction in residues in the well prevents the casing from being blocked. In the case where the downhole casing has certain inner diameter, the clamping seat has the thinner wall and the larger internal channel since the cone structure is removed. As the result, the flowing and flowback of the well fluid are facilitated and the flowback efficiency of the fracturing fluid or impurities in the well is high. Moreover, the plugging section of the plugging body can be thickened, thereby improving the supporting capability of the plugging body for the integrated collet and the plugging safety of the plugging system.

3. In the plugging method of the present disclosure, the clamping seat is set by operating the retrievable expansion cone. The setting barrel of the retrievable expansion cone can support the integrated collet from the interior of the integrated collet and limit the expansion deformation of the integrated collet, so that the integrated collet is subjected to outward expansion deformation radially. As such, the integrated collet can be stably set at the specified position of the downhole casing, thereby ensuring that the plugging body can plug the integrated collet safely later. By operating the plugging body to enter the set integrated collet for plugging, the integrated collet is assisted in bearing the pressure. As such, the well layer is stably plugged and the plugging construction is safer, thereby ensuring that fracturing reformation is performed safely.

The above description is only preferred embodiments of the present disclosure, and is not intended to limit the present disclosure. Any combination, modifications, equivalent replacements, improvements and the like made within the spirit and principles of the present disclosure should be contained within the scope of the protection of the present disclosure.

What is claimed is:

1. An integrated collet, comprising:

a collet body, wherein the collet body is capable of forming a seal with an inner wall of a downhole casing, and is anchored to the inner wall of the downhole casing; and an internal flow channel disposed inside the collet body along an axial direction of the collet body, wherein an inner wall of the internal flow channel of the collet body is a conical surface, wherein the collet body comprises a sealing ring and a slip, the slip comprises a slip bowl and a plurality of slip teeth, both the slip bowl and the sealing ring are plastically deformable members that retain their shapes after being subjected to expansion deformations and are integrated into one piece as an integrated member, the sealing ring is arranged at a first end of the slip bowl, a number of toothed plates are arranged at a second end of the slip bowl, and a gap exists between each pair of two adjacent toothed plates and is disposed along an axial direction of the slip bowl, and running through a first end of the slip bowl; and wherein each of the gap comprises a gap bottom and a gap neck, the gap bottom is a stress hole, the gap neck is a strip-shaped groove, the stress hole is one of a polygonal hole, an elliptical hole, a circular hole, or an oblong hole, wherein the oblong hole's length direction is perpendicular to the axial direction of the collet body, and is communicated with the strip-shaped groove, an opening of the strip-shaped groove is formed in an end away from the sealing ring, and the gap neck has a width smaller than that of the gap bottom.

2. An integrated collet, comprising:

a collet body, wherein the collet body is capable of forming a seal with an inner wall of a downhole casing, and is anchored to the inner wall of the downhole casing; and an internal flow channel disposed inside the collet body along an axial direction of the collet body, wherein an inner wall of the internal flow channel of the collet body is a conical surface;

wherein the collet body comprises a sealing ring and a slip, the slip comprises a slip bowl and a plurality of slip teeth, both the slip bowl and the sealing ring are plastically deformable members that retain their shapes after being subjected to expansion deformations and are integrated into one piece as an integrated member, the sealing ring is arranged at a first end of the slip bowl, a number of toothed plates are arranged at a second end of the slip bowl, and a gap exists between each pair of two adjacent toothed plates and is disposed along an axial direction of the slip bowl, and running through a first end of the slip bowl; and wherein each of the gap comprises a gap bottom and a gap neck, the gap bottom is a stress hole, the gap neck is a strip-shaped groove, the stress hole is a polygonal hole, the polygonal hole forms an elongated hole in a circumferential direction of the collet body and is perpendicular to the axial direction of the collet body, and two long sides of the elongated hole are parallel to each other, and is communicated with the strip-shaped groove, an opening of the strip-shaped groove is formed in an end away from the sealing ring, and the gap neck has a width smaller than that of the gap bottom.

3. A plugging method, comprising the following steps:

a setting step contains setting a clamping seat of a downhole plugging system by a retrievable expansion cone; and, a plugging step contains inserting a plugging section of a plugging body into an integrated collet that is set in a downhole casing, wherein, an outer wall of the plugging section abuts against an inner wall of the integrated collet, and the plugging section plugs an internal channel of the integrated collet; wherein, the retrievable expansion cone comprises a pushing barrel having a first end connected with a setting barrel, an outer wall of a first end, of the setting barrel that is away from the pushing barrel, is adapted to abut against the inner wall of the integrated collet, an adapter joint and a release lever are disposed axially in the pushing barrel, a first end of the release lever is connected with a first end of the adapter joint, and a second end of the release lever is connected with a lower joint of the clamping seat; and, the setting step comprises the following steps:

step I: passing the second end of the release lever through the integrated collet to detachably connect to the lower joint, wherein the setting barrel abuts against the inner wall of the integrated collet;

step II: feeding the retrievable expansion cone and the clamping seat to a specified setting position in a casing;

step III: applying an acting force towards the outside of a well to the adapter joint, and at the same time an acting force towards the inside of the well to the setting barrel with the pushing barrel, which causes the integrated collet moves along an outer wall of the setting barrel and deforms until its outer wall contacts with and is anchored to the inner wall of the casing; and step IV: recovering the retrievable expansion cone, thereby completing setting.

4. The plugging method according to claim 3, wherein the integrated collet comprises a collet body, the collet body is capable of forming a seal with an inner wall of a downhole casing and is anchored to the inner wall of the downhole casing, an internal channel is formed inside the collet body along its axial direction, and an inner wall of the internal channel of the collet body is a conical collet surface; and the plugging body comprises a plugging section provided with a support section thereon, the support section is of a hollow structure with a closed end, an outer wall of the support section is a conical plugging body surface, the closed end is located at a small end of a cone formed by the conical plugging body surface, and the conical collet surface and the conical plugging body surface match each other and form a seal.

5. The plugging method according to claim 4, wherein the collet body comprises a sealing ring and a slip, the slip comprises a slip bowl and a plurality of slip teeth, both the slip bowl and the sealing ring are plastically deformable members and are integrated into one piece, the slip bowl has the sealing ring at one end and is provided with a plurality of tooth plates at the other end, and a gap exists between each pair of two adjacent tooth plates and is disposed along an axial direction of the slip bowl.

6. The plugging method according to claim 4, wherein the plugging section further comprises a guide section connected with the closed end of the support section, an outer wall of the guide section is a conical guide section surface, and the outer wall of the guide section's slope at an axial direction of the plugging section is greater than that of the outer wall of the support section.

* * * * *